US005353602A

United States Patent [19]

Pincus

[11] Patent Number: 5,353,602

[45] Date of Patent: Oct. 11, 1994

[54] NON-STEADY-STATE SELF-REGULATING INTERMITTENT FLOW THERMODYNAMIC SYSTEM

[75] Inventor: Steven J. Pincus, New York, N.Y.

[73] Assignee: Calmac Manufacturing Corporation, Englewood, N.J.

[21] Appl. No.: 36,901

[22] Filed: Mar. 25, 1993

[51] Int. Cl.[5] ..... F25B 1/00

[52] U.S. Cl. ..... 62/115; 62/224; 62/527; 165/903

[58] Field of Search ..... 62/206, 224, 115, 498, 62/401, 527; 165/903

[56] References Cited

U.S. PATENT DOCUMENTS

| | | | |
|---|---|---|---|
| 1,314,234 | 8/1919 | Wolf | 62/224 X |
| 1,768,603 | 7/1930 | Hull | 62/224 X |
| 5,238,056 | 8/1993 | Scotti et al. | 165/903 X |

*Primary Examiner*—William E. Wayner
*Attorney, Agent, or Firm*—Charles J. Brown

[57] ABSTRACT

A thermodynamic system, such as a vapor compression refrigeration system, in which a binary expansion valve allows pulsed high velocity flow to an evaporator through an isentropic flow nozzle wherein the valve is controlled in response to evaporator pressure.

17 Claims, 5 Drawing Sheets

NON-STEADY-STATE SELF-REGULATING INTERMITTENT FLOW THERMODYNAMIC SYSTEM

BACKGROUND OF THE INVENTION

This invention relates to non-steady-state self-regulating intermittent flow refrigeration, heat pump, and air-conditioning systems utilizing non-steady-state thermodynamic cycles and non-steady-state metering systems. Non-steady-state metering systems incorporate nozzling devices that provide intermittent high velocity nozzling of fluid flow, and an internal system pressure based means for their actuation. Nozzling devices are integrally composed of two elements, a valve and a nozzle, that are typically non-specific with respect to the thermodynamic fluid utilized. The valve element is a full port flow device that is actuated based on internal system pressure, fully opening and closing in a binary fashion to provide intermittent unrestricted fluid flow through the nozzling device. The nozzle is a mechanically passive element which, due to its physical shape, functions to increase the velocity of fluid flow. Different nozzle designs can result in subsonic, sonic, or supersonic fluid velocities at the outlet of the nozzling device.

Non-steady-state thermodynamic cycles are characterized by intermittent fluid flows and non-steady-state pressures, temperatures, heat exchange processes, and work inputs. Within the non-steady-state thermodynamic systems, rate and metering of fluid flow, internal pressures, temperatures, heat exchange processes, and work inputs are self-regulated by the non-steady-state metering system as part of a mechanical feedback loop utilizing internal system pressure information that provides for continual system self-optimization with respect to thermodynamic efficiency. The self-optimization occurs in real time as environment conditions change.

The prior art of refrigeration, heat pump and air-conditioning systems utilize steady-state thermodynamic cycles and steady-state metering systems. Steady-state metering systems, and what are referred to as pulsating metering systems, incorporate throttling devices that provide steady, or pulsed throttling of fluid flow through a substantial flow restriction, and usually must be either changed or altered as one changes the operating thermodynamic fluid. Steady-state thermodynamic cycles are characterized by steady fluid flow and steady-state pressures, temperatures, heat exchange processes and work inputs. Within the steady-state thermodynamic systems, rate and metering of fluid flow, internal pressures and temperatures, heat exchange processes and work inputs are usually controlled by the pressure-flow characteristics of the throttling devices independent from or in conjunction with thermodynamic superheat determination. The pressure-flow characteristics are usually based on physical design parameters that presuppose system behavior and flow requirements with changing environment conditions, and attempt to achieve optimization of thermodynamic efficiency through imposition of engineering knowledge-based operating criteria.

The thermodynamic model that is used for the transfer of thermodynamic fluid through a nozzling device is an isentropic nozzling expansion process in which a substantial increase in fluid velocity occurs as thermodynamic fluid enthalpy, pressure, and temperature drops, and entropy remains constant. Transfer of thermodynamic fluid through a throttling valve in a steady-state system is modeled as a Joule-Thomson isenthalpic throttling expansion process in which there is negligible fluid velocity increase as thermodynamic fluid enthalpy remains constant, pressure and temperature drops, and entropy increases.

Fundamental thermodynamic principles are able to define and determine the efficiency and performance characteristics of both the non-steady-state and steady-state thermodynamic cycles. By replacing isenthalpic, entropy generating throttling flow processes with isentropic nozzling flow processes, non-steady-state thermodynamic cycles are more efficient than steady-state thermodynamic cycles.

SUMMARY OF THE INVENTION

The invention relates to novel refrigeration, heat pump, and air-conditioning systems in which the thermodynamic fluid is internally transferred in an intermittent fashion. Thermodynamic fluid flows, heat exchange processes and work inputs are not steady-state. Internal system pressures and temperatures are characterized by transients, ranges, and gradients. Rate and metering of thermodynamic fluid flow is self-regulated by the thermodynamic system as it continually seeks to reach equilibrium with changing internal and external environment conditions; maintaining homeostasis in a fashion modeled after a heart and its pressure regulation of a circulatory system. A heart will beat faster or slower to maintain blood pressure and flow, providing for energy transfer requirements. A nozzling device, as part of the non-steady-state metering system will open and close faster or slower to maintain thermodynamic fluid pressure and flow as the thermodynamic system exchanges energy with its environment.

The non-steady-state intermittent flow metering system is composed of an automatic reset close differential pressure switch that regulates the opening and closing of a mechanically-actuated nozzling device. The nozzling device functions as a nozzle with unrestricted fluid flow in its open condition, and as a means to prevent fluid flow in its closed condition. The mechanical component that provides the fully open and closed features of a nozzling device is a full port valve that rapidly opens to provide unrestricted flow through an internal nozzle when actuated. The nozzle is a passive internal structural component that increases the velocity of fluid flow due to its physical shape. A nozzle can consist of a straight section of conduit, a converging section of conduit, or a converging section followed by a diverging section of conduit. Straight, converging, and diverging nozzles are capable of producing up to sonic fluid velocities at their outlets. Converging-diverging nozzles are capable of producing supersonic fluid velocities at their outlets.

There are multiple variations on the structure and design of a nozzling device with respect to the integration of the valve and nozzle elements. A nozzling device can be composed of a complete and separate valve linked in series with a complete and separate nozzle, with the valve preceding the nozzle in the direction of fluid flow, or the nozzle preceding the valve in the direction of fluid flow. The valve and nozzle elements can also be integrally composed, with the inlet to the valve physically shaped and functioning as the nozzle inlet, and the valve outlet physically shaped and functioning as the nozzle outlet. In each of the preceding cases, and with variations on the preceding cases, the conjunction of the valve and the nozzle is considered to be the mechanically-actuated nozzling device.

The mechanically-actuated nozzling device can be composed of a solenoid-actuated valve of the type manufactured by Sporlan Valve Company, St. Louis, Mo., model number XRN, known as a 'rapid cycle solenoid valve', designed for extensive repeated opening and closing cycles; and appropriate inlet and outlet conduit connections that simultaneously function as nozzle elements to accelerate fluid flow. The valve bodies of Sporlan rapid cycle solenoid valves have partial converging-diverging nozzle aspects, with only slight flow restriction due to the converging aspect, and function as nozzles even though they were not designed for optimum acceleration of fluid flow.

A compressor or a pump maintains a pressure difference between the inlet and outlet of the nozzling device. Ideally, thermodynamic fluid flows through the valve portion of the nozzling device with no flow restriction, pressure drop or substantial change in thermodynamic property. Thermodynamic fluid flowing through the nozzle portion of the nozzling device experiences a substantial velocity increase as it flows from the high pressure to the low pressure side, dropping in pressure, temperature, and enthalpy while its entropy remains constant. The pressure switch has a close differential between its opening and closing pressures, and the switch contacts automatically open upon sensing the opening pressure and automatically close upon sensing the closing pressure. Internal pressure information is transferred to the pressure switch by means of a pressure tap into the thermodynamic system.

The pressure switch that regulates the opening and closing of the mechanical valve element of a nozzling device can be of the type made by Johnson Controls, Inc., Control Products Division, Goshen, Ind., model number P70FA-1C, known as an 'automatic reset close differential pressure switch', composed of a single pole double throw pressure actuated switch with a close differential of 1 to 2 pounds per square inch of pressure required to actuate the switch between its open and closed positions. The Johnson pressure switch has a single pressure setpoint, with automatic reset of the switch each time the setpoint is reached.

In a typical application, a pressure tap into the thermodynamic system supplies internal pressure information to the Johnson automatic reset close differential pressure switch, which regulates the opening and closing of the Sporlan rapid cycle solenoid valve based on the pressure setpoint. The Sporlan valve and the appropriate inlet and outlet conduit connections provide intermittent nozzling of fluid flow to an outlet conduit that is sensed by the pressure tap, resulting in a simple partial feedback loop that seeks to maintain the setpoint pressure in the conduit within the close differential of the pressure switch.

As the thermodynamic system provides for its cooling and heating loads and seeks equilibrium with its internal and external environment, internal thermodynamic system pressure transfers energy exchange information in a mechanical feedback loop between the pressure switch, the nozzling device, the heat exchangers, and the compressor or pump. The rate at which the nozzling device opens and closes is continuously determined in real time by the thermodynamic system as a whole, solely utilizing pressure information within the system. The mechanical feedback loop regulates and determines the intermittent flow rate of the thermodynamic fluid, internal system pressures and temperatures, heat exchange rates, and compressor or pump power input without any external assistance as it seeks a minimum entropy generating equilibrium state for the thermodynamic system. Thus the non-steady-state thermodynamic system is continuously self-optimizing in real time.

Due to the pressure and temperature ranges, transients, and gradients, non-steady-state heat exchange processes and work inputs of non-steady-state thermodynamic systems, an automatic reset close differential temperature switch can be used to provide close temperature regulation in the space to be cooled or heated. The temperature switch cycles a compressor or pump on and off to maintain temperature in the space. A delay timer can be used in conjunction with the temperature switch to avoid short cycling the compressor or pump.

Non-steady-state metering systems can replace all current steady-state flow, pressure, and temperature throttling valve based regulation devices in refrigeration, heat pump, and air-conditioning applications. All other components in non-steady-state intermittent flow system applications remain fundamentally the same as in steady-state system applications even though they provide for and experience non-steady-state thermodynamic fluid flow and the inherent differences therein.

Alternate uses for the nozzling devices include: functioning to provide for system suction pulldown when held fully closed and functioning to provide for hot gas defrost when held fully open. When used for system suction pulldown it is possible to return any refrigerant left in a service gauge and its hoses to the system when they are connected for making pressure measurements. This prevents unnecessary venting of the residual refrigerant into the atmosphere.

DESCRIPTION OF THE DRAWINGS

For an understanding of the present invention, reference should be made to the detailed description which follows and to the accompanying drawings in which.

DETAILED DESCRIPTION OF THE INVENTION

Figure 1:
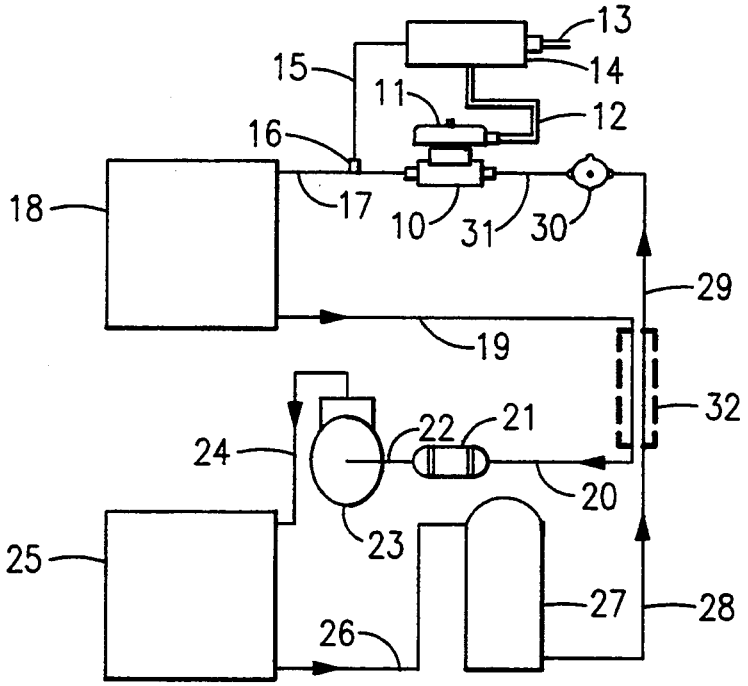
FIG. 1 shows a simple schematic for a non-steady-state self-regulating intermittent flow refrigeration or air-conditioning system.

In the refrigeration or air-conditioning system shown in FIG. 1, mechanical actuation of the nozzling device is provided by a solenoid. The solenoid-actuated nozzling device 10 regulates the flow of a refrigerant to a heat exchanger 18 in which the refrigerant takes on heat from the environment to be cooled. Refrigerant then flows through a filter-drier 21 to a compressor 23. Compressed refrigerant flows to a heat exchanger 25 in which the refrigerant releases heat to the environment to be heated. Counter-flow heat exchanger 32 provides for heat exchange between the thermodynamic fluid flowing from the outlet of heat exchanger 18 to the compressor 23 and the thermodynamic fluid that flows from the outlet of heat exchanger 25 to the nozzling device 10. Refrigerant continually cycles through the system in an intermittent fashion as the pressure switch 14 responds to internal pressure information, alternately opening and closing the nozzling device 10.

Solenoid-actuated nozzling device 10 is actuated by solenoid coil 11 which fully opens the valve element when electrically energized and fully closes the valve element when deenergized. Automatic reset close differential pressure switch 14 regulates the energization and deenergization of the solenoid coil 11. Electrical conduit 12 transfers electrical power between the electric contacts of pressure switch 14 and the solenoid coil 11. Electrical conduit 13 supplies electrical power to the solenoid coil 11 through the electric contacts of switch 14 and electrical conduit 12. Electric power from conduit 13 fully opens the nozzling device 10 when the contacts of switch 14 complete an electrical circuit between 13, 12, and 11. When the electrical circuit between 13, 12, and 11 is broken by the opening of the electrical contacts of the switch 14, the solenoid coil 11 is deenergized and the nozzling device 10 returns to its normally closed condition.

Capillary tube 15 transfers pressure information from downstream of the nozzling device 10 to the pressure switch 14. The pressure at which the switch is set to open the nozzling device 10 is chosen by human design criterion. Pressure information from within the system conduit 17 is transferred to the capillary tube 15 by the pressure tap 16. As compressor 23 lowers the pressure in the suction side of the thermodynamic system, pressure switch 14 opens nozzling device 10 when the pressure drops below a predetermined switch setting, permitting flow of the thermodynamic fluid from within the upstream system conduit 31 through the nozzling device 10 to the downstream system conduit 17. As the high velocity burst of thermodynamic fluid enters the downstream conduit 17 it produces an internal system pressure rise within the suction side of the system. When the internal system pressure within conduit 17 is above the automatic reset close differential of the pressure switch setting the electric contacts of the pressure switch 14 open and the solenoid coil 11 deenergizes closing the nozzling device 10 and stopping thermodynamic fluid flow through the nozzling device 10. With the nozzling device 10 closed the compressor 23 lowers the suction side pressure until it is below the pressure switch setting, resulting in the reopening of the nozzling device 10. As the nozzling device 10 alternates between fully open and fully closed conditions, internal thermodynamic fluid alternately flows and does not flow within the thermodynamic system.

The high velocity burst of thermodynamic fluid that enters the system downstream conduit 17 flows into the heat exchanger 18. In vapor-compression refrigeration or air-conditioning applications, heat exchanger 18 is an evaporator in which the refrigerant changes thermodynamic state from a liquid or mixed liquid-vapor state to a vapor state as heat energy is transferred from the external environment to the refrigerant. In gas refrigeration or air-conditioning applications the refrigerant within the heat exchanger 18 remains in the gas phase as heat energy is transferred from the external environment to the refrigerant. In both vapor-compression and gas system applications heat energy transferred from the external environment to the internal thermodynamic fluid cools the external environment.

The high velocity burst of thermodynamic fluid flows into the heat exchanger 18 through a conduit 17 and out through a conduit 19 to a counter-flow heat exchanger 32. Thermodynamic fluid flows out of counter-flow heat exchanger 32 through the conduit 20 to a suction line filter-drier 21, and through a conduit 22 to the compressor 23. Counter-flow heat exchanger 32 serves to further lower the temperature of the refrigerant leaving the heat exchanger 25 and entering the nozzling device 10 by exchanging heat with the lower temperature refrigerant leaving heat exchanger 18. Counter-flow heat exchanger 32 may not be used in applications where the cooling of compressor 23 is dependent on the return of sufficiently low temperature suction line refrigerant.

The compressor 23 transfers mechanical energy to the thermodynamic fluid, increasing the pressure and temperature of the refrigerant and discharging it through the conduit 24 to the heat exchanger 25. The thermodynamic state of the refrigerant leaving the compressor 23 through the conduit 24 is in a superheated vapor state at a pressure and temperature above that of the refrigerant entering the compressor 23 through the conduit 22.

In vapor-compression refrigeration or air-conditioning applications heat exchanger 25 is a condenser in which thermodynamic fluid changes thermodynamic state from a superheated vapor state to a liquid state as heat energy is transferred from the thermodynamic fluid to heat the external environment.

In gas refrigeration or air-conditioning applications, the refrigerant within the heat exchanger 25 remains in the gas phase as heat energy is transferred from the thermodynamic fluid to heat the external environment.

In vapor-compression refrigeration or air-conditioning applications thermodynamic fluid flows out of heat exchanger 25 through a conduit 26 to a liquid reservoir 27 and out of the liquid reservoir 27 through a conduit 28 to the counter-flow heat exchanger 32. The thermodynamic fluid that enters the counter-flow heat exchanger 32 through the conduit 28 in counter-flow heat relationship with the thermodynamic fluid flowing from the heat exchanger 20 to the compressor 28 emerges through the conduit 29 and returns to the nozzling device 10 to complete a thermodynamic cycle. A liquid-line sight glass 30 and a connecting conduit 31 may be provided upstream of the nozzling device 10 to indicate the quality of the refrigerant in the system. The liquid-line sight glass 30 and the liquid reservoir 27 are not required in a gas system application. The liquid-line sight glass 30 and the liquid reservoir 27 may not be required by a vapor-compression system application.

Figure 2:
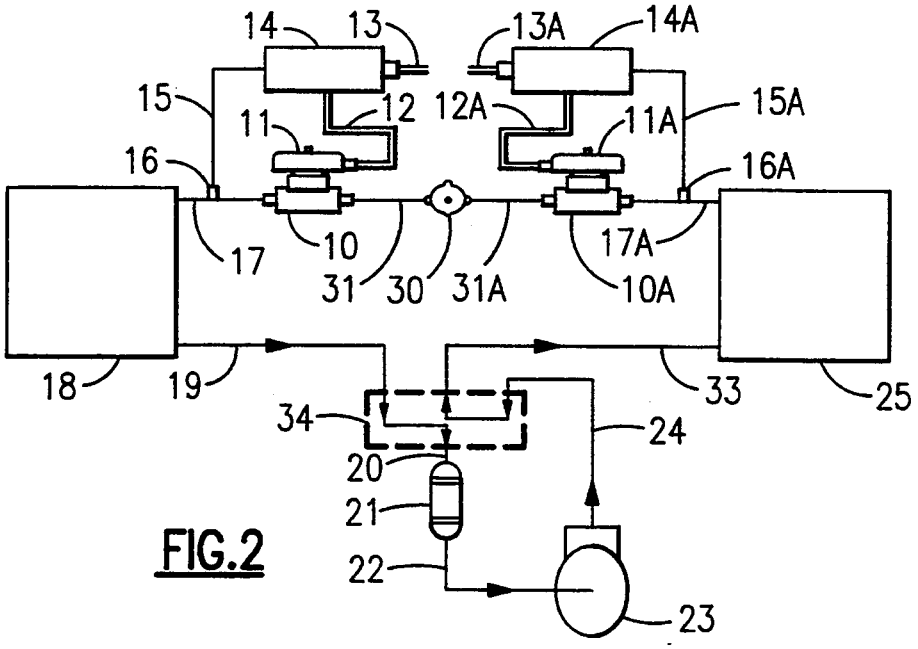
FIGS. 2 and 3 show simple schematics for a non-steady-state self-regulating intermittent flow heat pump system.

In the heat pump system shown in its cooling mode in FIG. 2, the nozzling devices are actuated by solenoids. The solenoid-actuated nozzling device 10 regulates the flow of a refrigerant to a heat exchanger 18 in which the refrigerant takes on heat from the environment to be cooled. The refrigerant then flows through a four-way reversing valve 34 held in its cooling mode flow condition to a filter-drier 21 and then to a compressor 23. The compressed refrigerant then flows back through the four-way reversing valve 34 to a heat exchanger 25 in which the refrigerant releases heat to the environment to be heated. The refrigerant then flows through the solenoid-actuated nozzling device 10A which is held fully open to allow for continual unrestricted flow to the nozzling device 10 to complete the thermodynamic cycle. Refrigerant continually cycles through the system in an intermittent fashion as the pressure switch responds to internal pressure information, alternately opening and closing the nozzling device 10.

Solenoid-actuated nozzling device 10 is actuated by solenoid coil 11 which fully opens the valve element when electrically energized and fully closes the valve element when deenergized. Automatic reset close differential pressure switch 14 regulates the energization and deenergization of the solenoid coil 11. Electrical conduit 12 transfers electrical power between the electric contacts of pressure switch 14 and the solenoid coil 11. Electrical conduit 13 supplies electrical power to the solenoid coil 11 through the electric contacts of switch 14 and electrical conduit 12. Electric power from conduit 13 fully opens the nozzling device 10 when the contacts of switch 14 complete an electrical circuit between 13, 12, and 11. When the electrical circuit between 13, 12, and 11 is broken by the opening of the electrical contacts of the switch 14, the solenoid coil 11 is deenergized and the nozzling device 10 returns to its normally closed condition.

Capillary tube 15 transfers pressure information from downstream of the nozzling device 10 to the pressure switch 14. The pressure at which the switch is set to open the nozzling device 10 is chosen by human design criterion. Pressure information from within the system conduit 17 is transferred to the capillary tube 15 by the pressure tap 16. As compressor 23 lowers the pressure in the suction side of the thermodynamic system, pressure switch 14 opens nozzling device 10 when the pressure drops below a predetermined switch setting, permitting flow of the thermodynamic fluid from within the upstream system conduit 31 through the nozzling device 10 to the downstream system conduit 17. As the high velocity burst of thermodynamic fluid enters the downstream conduit 17 it produces an internal system pressure rise within the suction side of the system. When the internal system pressure within conduit 17 is above the automatic reset close differential of the pressure switch setting the electric contacts of the pressure switch 14 open and the solenoid coil 11 deenergizes closing the nozzling device 10 and stopping thermodynamic fluid flow through the nozzling device 10. With the nozzling device 10 closed the compressor 23 lowers the suction side pressure until it is below the pressure switch setting, resulting in the reopening of the nozzling device 10. As the nozzling device 10 alternates between fully open and fully closed conditions, internal thermodynamic fluid alternately flows and does not flow within the thermodynamic system.

The high velocity burst of thermodynamic fluid that enters the system downstream conduit 17 flows into the heat exchanger 18. In vapor-compression heat pump applications, heat exchanger 18 is an evaporator in which the refrigerant changes thermodynamic state from a liquid or mixed liquid-vapor state to a vapor state as heat energy is transferred from the external environment to the refrigerant. In gas heat pump applications the refrigerant within the heat exchanger 18 remains in the gas phase as heat energy is transferred from the external environment to the refrigerant. In both vapor-compression and gas system applications heat energy transferred from the external environment to the internal thermodynamic fluid cools the external environment.

The high velocity burst of thermodynamic fluid flows into the heat exchanger 18 through a conduit 17 and out through a conduit 19 to a four-way reversing valve 34. The four-way reversing valve changes the direction of fluid flow so that heat exchangers 18 and 25 switch between being cooling and heating devices. Thermodynamic fluid flows out of four-way reversing valve 34 through the conduit 20 to a suction line filter-drier 21, and through a conduit 22 to the compressor 23.

The compressor 23 transfers mechanical energy to the thermodynamic fluid, increasing the pressure and temperature of the refrigerant and discharging it through the conduit 24 to the four-way reversing valve 34. Refrigerant flows out of four-way reversing valve 34 through conduit 33 to heat exchanger 25. The thermodynamic state of the refrigerant leaving the compressor 23 through the conduit 24 is in a superheated vapor state at a pressure and temperature above that of the refrigerant entering the compressor 23 through the conduit 22.

In vapor-compression heat pump applications heat exchanger 25 is a condenser in which thermodynamic fluid changes thermodynamic state from a superheated vapor state to a liquid state as heat energy is transferred from the thermodynamic fluid to heat the external environment.

In gas heat pump applications, the refrigerant within the heat exchanger 25 remains in the gas phase as heat energy is transferred from the thermodynamic fluid to heat the external environment.

The refrigerant flows from the heat exchanger 25 through conduit 17A through the solenoid-actuated nozzling device 10A which is held fully open to allow for continual unrestricted flow to the nozzling device 10 to complete the thermodynamic cycle. Nozzling device 10A is held fully open by solenoid coil 11A. Solenoid coil 11A is electrically energized by power from electrical conduit 13A. Thermodynamic fluid flowing through nozzling device 10A enters conduit 31A and flows through liquid-line sight glass 30 and conduit 31 to the inlet of nozzling device 10. Liquid-line sight glass 30 is not required in a gas system application. Liquid-line sight glass 30 may not be required by a vapor-compression system application.

Figure 3:
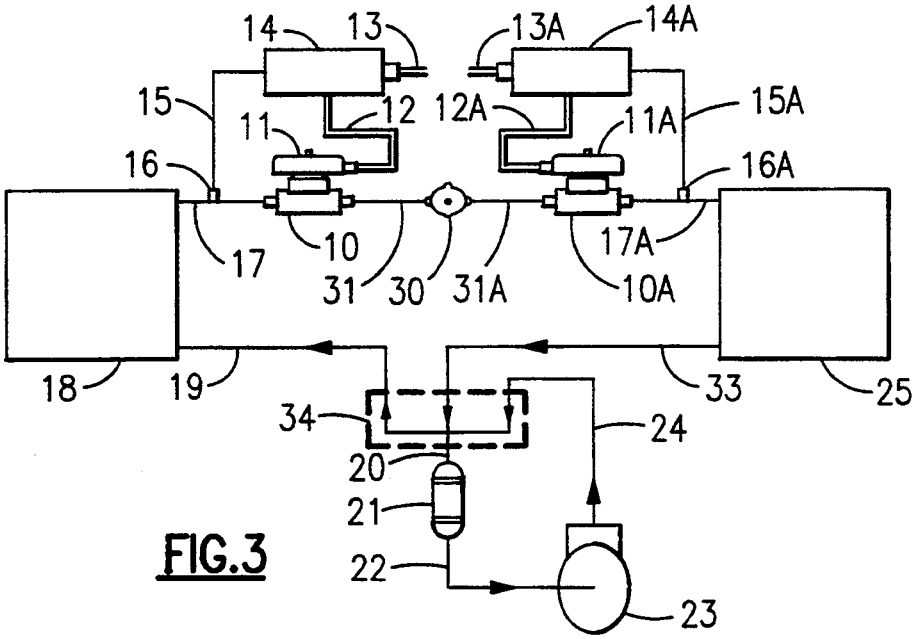

In the heat pump system shown in its heating mode in FIG. 3, the nozzling devices are actuated by solenoids. The reversing valve 34 is in the heating mode, reversing the direction of flow of refrigerant between heat exchangers 18 and 25 from the direction of flow indicated in FIG. 2. The solenoid-actuated nozzling device 10A regulates the flow of a refrigerant to a heat exchanger 25 in which the refrigerant takes on heat from the environment to be cooled. The refrigerant then flows through a four-way reversing valve 34 held in its heating mode flow condition to a filter-drier 21 and then to a compressor 23. The compressed refrigerant then flows back through the four-way reversing valve 34 to a heat exchanger 18 in which the refrigerant releases heat to the environment to be heated. The refrigerant then flows through the solenoid-actuated nozzling device 10 which is held fully open to allow for continual unrestricted flow to the nozzling device 10A to complete the thermodynamic cycle. Refrigerant continually cycles through the system in an intermittent fashion as the pressure switch 14A responds to internal pressure information, alternately opening and closing the nozzling device 10A.

Solenoid-actuated nozzling device 10A is actuated by solenoid coil 11A which fully opens the valve element when electrically energized and fully closes the valve element when deenergized. Automatic reset close differential pressure switch 14A regulates the energization and deenergization of the solenoid coil 11A. Electrical conduit 12A transfers electrical power between the electric contacts of pressure switch 14A and the solenoid coil 11A. Electrical conduit 13A supplies electrical power to the solenoid coil 11A through the electric contacts of switch 14A and electrical conduit 12A. Electric power from conduit 13A fully opens the nozzling device 10A when the contacts of switch 14A complete an electrical circuit between 13A, 12A, and 11A. When the electrical circuit between 13A, 12A, and 11A is broken by the opening of the electrical contacts of the switch 14A, the solenoid coil 11A is deenergized and the nozzling device 10A returns to its normally closed condition.

Capillary tube 15A transfers pressure information from downstream of the nozzling device 10A to the pressure switch 14A. The pressure at which the switch is set to open the nozzling device 10A is chosen by human design criterion. Pressure information from within the system conduit 17A is transferred to the capillary tube 15A by the pressure tap 16A. As compressor 23 lowers the pressure in the suction side of the thermodynamic system, pressure switch 14A opens nozzling device 10A when the pressure drops below a predetermined switch setting, permitting flow of the thermodynamic fluid from within the upstream system conduit 33 through the nozzling device 10A to the downstream system conduit 17A. As the high velocity burst of thermodynamic fluid enters the downstream conduit 17A it produces an internal system pressure rise within the suction side of the system. When the internal system pressure within conduit 17A is above the automatic reset close differential of the pressure switch setting the electric contacts of the pressure switch 14A open and the solenoid coil 11A deenergizes closing the nozzling device 10A and stopping thermodynamic fluid flow through the nozzling device 10A. With the nozzling device 10A closed the compressor 23 lowers the suction side pressure until it is below the pressure switch setting, resulting in the reopening of the nozzling device 10A. As the nozzling device 10A alternates between fully open and fully closed conditions, internal thermodynamic fluid alternately flows and does not flow within the thermodynamic system.

The high velocity burst of thermodynamic fluid that enters the system downstream conduit 17A flows into the heat exchanger 25. In vapor-compression heat pump applications, heat exchanger 25 is an evaporator in which the refrigerant changes thermodynamic state from a liquid or mixed liquid-vapor state to a vapor state as heat energy is transferred from the external environment to the refrigerant. In gas heat pump applications the refrigerant within the heat exchanger 25 remains in the gas phase as heat energy is transferred from the external environment to the refrigerant. In both vapor-compression and gas system applications heat energy transferred from the external environment to the internal thermodynamic fluid cools the external environment.

The high velocity burst of thermodynamic fluid flows into the heat exchanger 25 through a conduit 17A and out through a conduit 33 to a four-way reversing valve 34. The four-way reversing valve changes the direction of fluid flow so that heat exchangers 18 and 25 switch between being cooling and heating devices. The thermodynamic fluid flows out of four-way reversing valve 34 through the conduit 20 to a suction line filter-drier 21, and through a conduit 22 to the compressor 23.

The compressor 23 transfers mechanical energy to the thermodynamic fluid, increasing the pressure and temperature of the refrigerant and discharging it through the conduit 24 to the four-way reversing valve 34. Refrigerant flows out of four-way reversing valve 34 through conduit 19 to heat exchanger 18. The thermodynamic state of the refrigerant leaving the compressor 23 through the conduit 24 is in a superheated vapor state at a pressure and temperature above that of the refrigerant entering the compressor 23 through the conduit 22.

In vapor-compression heat pump applications heat exchanger 18 is a condenser in which thermodynamic fluid changes thermodynamic state from a superheated vapor state to a liquid state as heat energy is transferred from the thermodynamic fluid to heat the external environment.

In gas heat pump applications, the refrigerant within the heat exchanger 18 remains in the gas phase as heat energy is transferred from the thermodynamic fluid to heat the external environment.

The refrigerant flows from the heat exchanger 18 through conduit 17 through the solenoid-actuated nozzling device 10 which is held fully open to allow for continual unrestricted flow to the nozzling device 10A to complete the thermodynamic cycle. Nozzling device 10 is held fully open by solenoid coil 11. Solenoid coil 11 is electrically energized by power from electrical conduit 13. Thermodynamic fluid flowing through nozzling device 10 enters conduit 31 and flows through liquid-line sight glass 30 and conduit 31A to the inlet of nozzling device 10A. Liquid-line sight glass 30 is not required in a gas system application. Liquid-line sight glass 30 may not be required by a vapor-compression system application.

Figure 4:
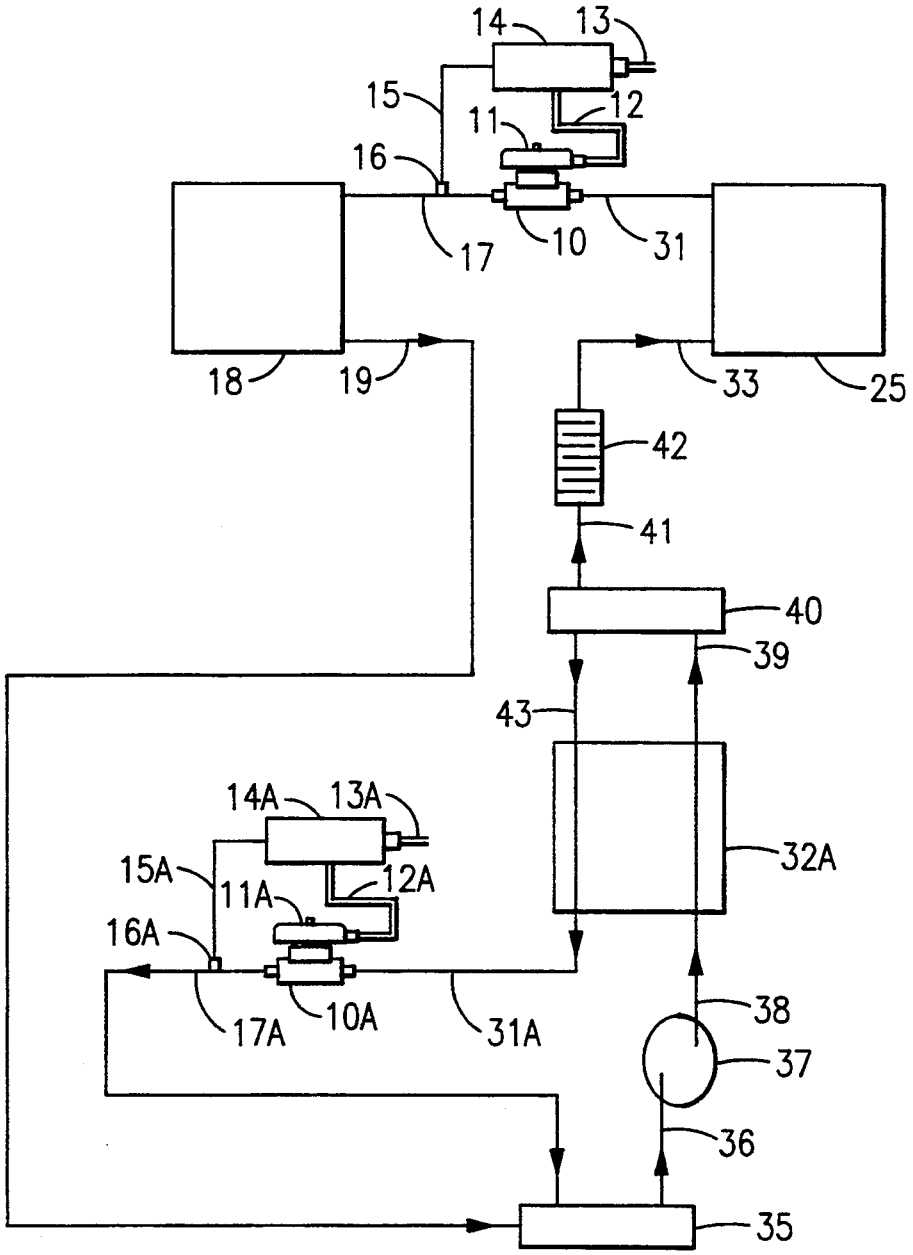
FIG. 4 shows a simple schematic for a non-steady-state self-regulating intermittent flow absorption refrigeration system.

In the absorption refrigeration system shown in FIG. 4, the nozzling devices are actuated by solenoids. The solenoid-actuated nozzling device 10 regulates the flow of a refrigerant to an evaporator heat exchanger 18 in which the refrigerant takes on heat from the environment to be cooled. The refrigerant vapor then flows into absorber 35 where it is absorbed by thermodynamic fluid in the liquid state, releasing heat energy in an exothermic process to the ambient environment. A pump 37 pressurizes the liquid from absorber 35, pumping it through counter-flow heat exchanger 32A into vapor generator 40. The high pressure liquid in vapor generator 40 absorbs heat energy from a higher temperature ambient source, releasing the refrigerant vapor absorbed into the liquid in absorber 35 as a high pressure and high temperature vapor. The high pressure and high temperature refrigerant vapor flows from vapor generator 40 to rectifier 42 which removes any water in the liquid or vapor phase from the refrigerant vapor. The dry vapor leaving rectifier 42 condenses into liquid refrigerant in condenser heat exchanger 25 which releases heat energy to the ambient environment. Liquid refrigerant from condenser 25 flows to the inlet of nozzling device 10 to complete a thermodynamic cycle. Liquid absorbent fluid from vapor generator 40 flows back through the conduit 43 to the counter-flow heat exchanger 32A, where it exchanges heat energy with fluid flowing from pump 37 to vapor generator 40, and then through conduit 31A to nozzling device 10A which opens and closes to meter absorbent fluid flow back to absorber 35. Refrigerant continually cycles through the system in an intermittent fashion as the pressure switch 14 responds to internal pressure information, alternately opening and closing the nozzling device 10. Absorbent fluid continually cycles through its system loop in an intermittent fashion as the pressure switch 14A responds to internal pressure information, alternately opening and closing the nozzling device 10A.

Solenoid-actuated nozzling device 10 is actuated by solenoid coil 11 which fully opens the valve element when electrically energized and fully closes the valve element when deenergized. Automatic reset close differential pressure switch 14 regulates the energization and deenergization of the solenoid coil 11. Electrical conduit 12 transfers electrical power between the electric contacts of pressure switch 14 and the solenoid coil 11. Electrical conduit 13 supplies electrical power to the solenoid coil 11 through the electric contacts of switch 14 and electrical conduit 12. Electric power from conduit 13 fully opens the nozzling device 10 when the contacts of switch 14 complete an electrical circuit between 13, 12, and 11. When the electrical circuit between 13, 12, and 11 is broken by the opening of the electrical contacts of the switch 14, the solenoid coil 11 is deenergized and the nozzling device 10 returns to its normally closed condition.

Capillary tube 15 transfers pressure information from downstream of the nozzling device 10 to the pressure switch 14. The pressure at which the switch is set to open the nozzling device 10 is chosen by human design criterion. Pressure information from within the system conduit 17 is transferred to the capillary tube 15 by the pressure tap 16. As pump 37 lowers the pressure in the suction side of the thermodynamic system, pressure switch 14 opens nozzling device 10 when the pressure drops below a predetermined switch setting, permitting flow of the thermodynamic fluid from within the upstream system conduit 31 through the nozzling device 10 to the downstream system conduit 17. As the high velocity burst of thermodynamic fluid enters the downstream conduit 17 it produces an internal system pressure rise within the suction side of the system. When the internal system pressure within conduit 17 is above the automatic reset close differential of the pressure switch setting the electric contacts of the pressure switch 14 open and the solenoid coil 11 deenergizes closing the nozzling device 10 and stopping thermodynamic fluid flow through the nozzling device 10. With the nozzling device 10 closed the pump 37 lowers the suction side pressure until it is below the pressure switch setting, resulting in the reopening of the nozzling device 10. As the nozzling device 10 alternates between fully open and fully closed conditions, refrigerant fluid alternately flows and does not flow within the thermodynamic system.

The high velocity burst of thermodynamic fluid that enters the system downstream conduit 17 flows into the heat exchanger 18. Heat exchanger 18 is an evaporator in which the refrigerant changes thermodynamic state from a liquid or mixed liquid-vapor state to a vapor state as heat energy is transferred from the external environment to the refrigerant. Heat energy transferred from the external environment to the internal thermodynamic fluid cools the external environment.

The high velocity burst of thermodynamic fluid flows into the heat exchanger 18 through a conduit 17 and out through a conduit 19 to an absorber 35. Vapor from evaporator 18 is absorbed by the liquid absorbent fluid within absorber 35 in an exothermic process, releasing heat energy to the external environment. Liquid absorbent fluid is pumped out of absorber 35 through conduit 36 by pump 37. Pump 37 raises the pressure of the liquid absorbent fluid and discharges the pressurized liquid through conduit 38 to counter-flow heat exchanger 32A. Pressurized liquid absorbent fluid that enters counter-flow heat exchanger 32A through conduit 38 leaves through conduit 39 and enters vapor generator 40. Heat energy from a higher temperature ambient environment is transferred to vapor generator 40 so that refrigerant vapor is released from the absorbent fluid in an endothermic process. The high pressure refrigerant vapor leaves vapor generator 40 through conduit 41 and flows to rectifier 42 which functions as a desiccant to remove any water in the liquid or vapor phase from the refrigerant vapor. Dry refrigerant vapor leaves rectifier 42 through conduit 33 and enters condenser heat exchanger 25. Dry refrigerant vapor within condenser heat exchanger 25 changes thermodynamic state to refrigerant liquid as it releases heat energy to heat the external environment. Liquid refrigerant leaves condenser 25 through conduit 31 and flows to the inlet of nozzling device 10 to complete a thermodynamic cycle. In absorption refrigeration applications in which water is the refrigerant, rectifier 42 is not required.

High pressure liquid absorbent fluid from vapor generator 40 leaves through conduit 43 and flows through counter-flow heat exchanger 32A, where it transfers heat energy to absorbent fluid flowing from pump 37 to vapor generator 40, preheating the absorbent fluid before it enters vapor generator 40. Liquid absorbent fluid entering counter-flow heat exchanger 32A through conduit 43 leaves counter-flow heat exchanger 32A through conduit 31A and flows to the inlet of nozzling device 10A. Nozzling device 10A opens and closes to meter absorbent fluid flow back to absorber 35.

Solenoid-actuated nozzling device 10A is actuated by solenoid coil 11A which fully opens the valve element when electrically energized and fully closes the valve element when deenergized. Automatic reset close differential pressure switch 14A regulates the energization and deenergization of the solenoid coil 11A. Electrical conduit 12A transfers electrical power between the electric contacts of pressure switch 14A and the solenoid coil 11A. Electrical conduit 13A supplies electrical power to the solenoid coil 11A through the electric contacts of switch 14A and electrical conduit 12A. Electric power from conduit 13A fully opens the nozzling device 10A when the contacts of switch 14A complete an electrical circuit between 13A, 12A, and 11A.

When the electrical circuit between 13A, 12A, and 11A is broken by the opening of the electrical contacts of the switch 14A, the solenoid coil 11A is deenergized and the nozzling device 10A returns to its normally closed condition.

Capillary tube 15A transfers pressure information from downstream of the nozzling device 10A to the pressure switch 14A. The pressure at which the switch is set to open the nozzling device 10A is chosen by human design criterion. Pressure information from within the system conduit 17A is transferred to the capillary tube 15A by the pressure tap 16A. As pump 37 lowers the pressure in the suction side of the thermodynamic system, pressure switch 14A opens nozzling device 10A when the pressure drops below a predetermined switch setting, permitting flow of the thermodynamic fluid from within the upstream system conduit 31A through the nozzling device 10A to the downstream system conduit 17A. As the high velocity burst of thermodynamic fluid enters the downstream conduit 17A it produces an internal system pressure rise within the suction side of the system. When the internal system pressure within conduit 17A is above the automatic reset close differential of the pressure switch setting the electric contacts of the pressure switch 14A open and the solenoid coil 11A deenergizes closing the nozzling device 10A and stopping thermodynamic fluid flow through the nozzling device 10A. With the nozzling device 10A closed the pump 37 lowers the suction side pressure until it is below the pressure switch setting, resulting in the reopening of the nozzling device 10A. As the nozzling device 10A alternates between fully open and fully closed conditions, liquid absorbent fluid alternately flows and does not flow within the thermodynamic system.

Replacement of steady-state throttling valve based pressure, temperature, and flow regulation devices with non-steady-state metering devices is accomplished by utilizing the appropriate automatic reset close differential pressure switch in conjunction with a nozzling device; and by the appropriate placement of pressure taps within the thermodynamic system. Some non-steady-state metering system configurations are as follows:

1) The normally closed nozzling device opens on a decrease in downstream pressure below the pressure switch setting.

2) The normally closed nozzling device opens on an increase in downstream pressure above the pressure switch setting.

3) The normally closed nozzling device opens on a decrease in upstream pressure below the pressure switch setting.

4) The normally closed nozzling device opens on an increase in upstream pressure above the pressure switch setting.

5) The normally closed nozzling device opens on a decrease in differential pressure between the upstream and downstream pressures.

6) The normally closed nozzling device opens on an increase in differential pressure between the upstream and downstream pressures.

7) The normally open nozzling device closes on a decrease in downstream pressure below the pressure switch setting.

8) The normally open nozzling device closes on an increase in downstream pressure above the pressure switch setting.

9) The normally open nozzling device closes on a decrease in upstream pressure below the pressure switch setting.

10) The normally open nozzling device closes on an increase in upstream pressure above the pressure switch setting.

11) The normally open nozzling device closes on a decrease in differential pressure between the upstream and downstream pressures.

12) The normally open nozzling device closes on an increase in differential pressure between the upstream and downstream pressures.

Figure 5:
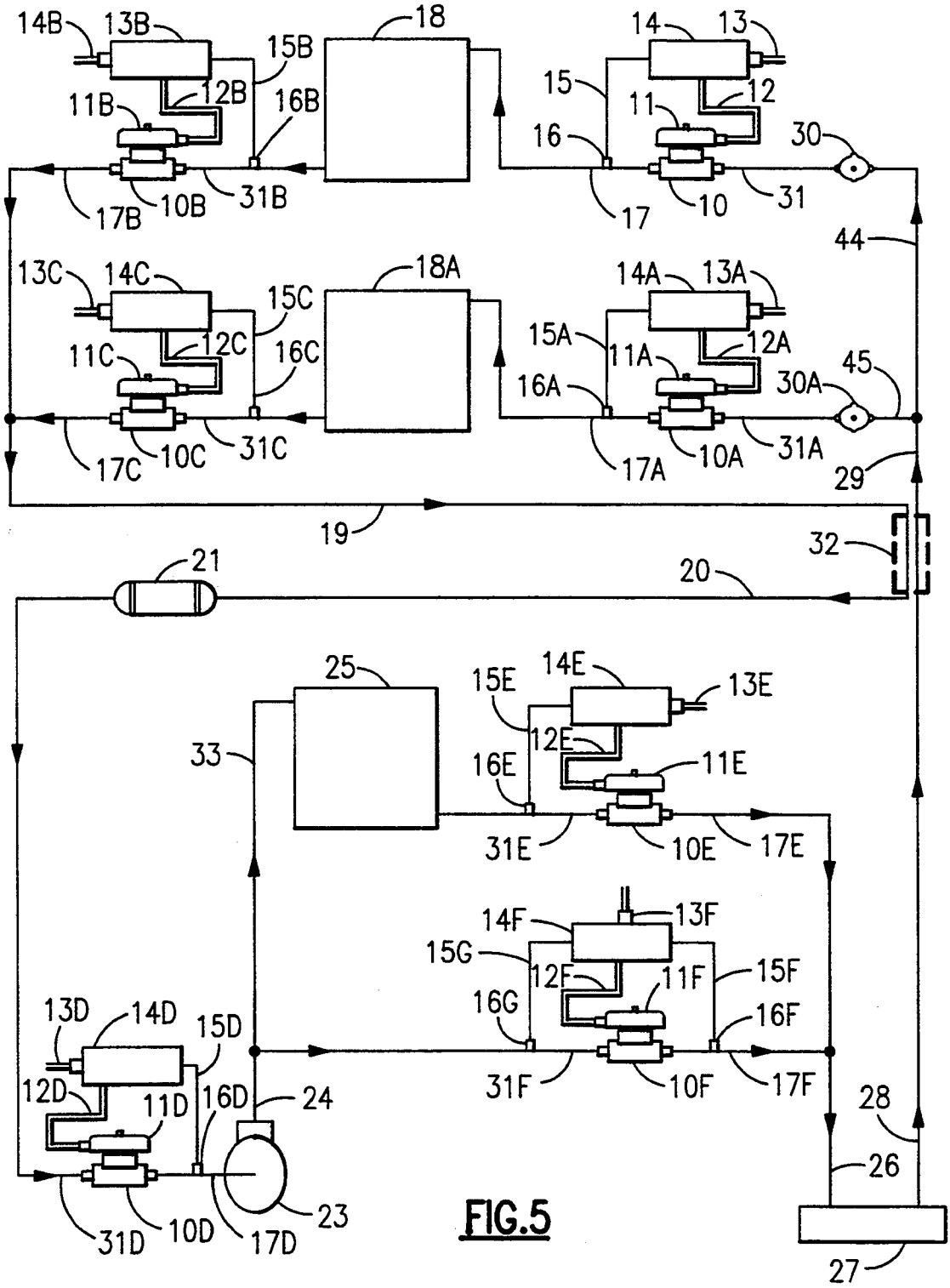
FIG. 5 shows a simple schematic for a non-steady-state self-regulating intermittent flow refrigeration or air-conditioning system with simple conjunctions of variations on the fundamental non-steady-state intermittent flow metering unit.

FIG. 5 shows a non-steady-state refrigeration or air-conditioning system utilizing some of the aforementioned variations of non-steady-state metering devices for temperature, pressure, and flow regulation. The non-steady-state refrigeration or air-conditioning system is a representative vapor-compression system with variations consisting of dual evaporators, each with evaporator pressure regulating devices on their respective downstream sides, a crankcase pressure regulating device on the inlet of the compressor on its suction side, a condenser pressure regulating device on the outlet of the condenser, and a differential pressure regulating device that bypasses high pressure thermodynamic fluid from the compressor outlet directly to the downstream side of the condenser pressure regulating device.

The non-steady-state metering unit integrally comprised of 10, 11, 12, 13, 14, and 15 respectively functions to fully open the normally fully closed nozzling device 10 on a decrease in downstream pressure below the pressure switch 14 pressure setting. Downstream internal thermodynamic system pressure from system conduit 17 is transferred through pressure tap 16 to pressure switch 14 by capillary tube 15. The non-steady-state metering unit functions as an expansion and metering device.

The non-steady-state metering unit integrally comprised of 10A, 11A, 12A, 13A, 14A, and 15A respectively functions to fully open the normally fully closed nozzling device 10A on a decrease in downstream pressure below the pressure switch 14A pressure setting. Downstream internal thermodynamic system pressure from system conduit 17A is transferred through pressure tap 16A to pressure switch 14A by capillary tube 15A. The non-steady-state metering unit functions as an expansion and metering device.

The non-steady-state metering unit integrally comprised of 10B, 11B, 12B, 13B, 14B, and 15B respectively functions to fully open the normally fully closed nozzling device 10B on an increase in upstream pressure above the pressure switch 14B pressure setting. Upstream internal thermodynamic system pressure from system conduit 31B is transferred through pressure tap 16B to pressure switch 14B by capillary tube 15B. The non-steady-state metering unit functions as an evaporator pressure regulating device.

The non-steady-state metering unit integrally comprised of 10C, 11C, 12C, 13C, 14C, and 15C respectively functions to fully open the normally fully closed nozzling device 10C on an increase in upstream pressure above the pressure switch 14C pressure setting. Upstream internal thermodynamic system pressure from system conduit 31C is transferred through pressure tap 16C to pressure switch 14C by capillary tube 15C. The non-steady-state metering unit functions as an evaporator pressure regulating device.

The non-steady-state metering unit integrally comprised of 10D, 11D, 12D, 13D, 14D, and 15D respectively functions to fully close the normally fully open nozzling device 10D on an increase in downstream pressure above the pressure switch 14D pressure setting. Downstream internal thermodynamic system pressure from system conduit 17D is transferred through pressure tap 16D to pressure switch 14D by capillary tube 15D. The non-steady-state metering unit functions as a compressor crankcase pressure regulating device.

The non-steady-state metering unit integrally comprised of 10E, 11E, 12E, 13E, 14E, and 15E respectively functions to fully open the normally fully closed nozzling device 10E on an increase in upstream pressure above the pressure switch 14E pressure setting. Upstream internal thermodynamic system pressure from system conduit 31E is transferred through pressure tap 16E to pressure switch 14E by capillary tube 15E. The non-steady-state metering unit functions as a condenser pressure regulating device.

The non-steady-state metering unit integrally comprised of 10F, 11F, 12F, 13F, 14F, 15F, and 15G respectively functions to fully open the normally fully closed nozzling device 10F on an increase in differential upstream to downstream pressure above the differential pressure switch 14F differential pressure setting. Upstream internal thermodynamic system pressure from system conduit 31F is transferred through pressure tap 16G to differential pressure switch 14F by capillary tube 15G. Downstream internal thermodynamic system pressure from system conduit 17F is transferred through pressure tap 16F to differential pressure switch 14F by capillary tube 15F. The non-steady-state metering unit functions as a thermodynamic fluid pressure and flow regulating device bypassing compressor discharge fluid past the condenser.

In the vapor-compression refrigeration or air-conditioning system shown in FIG. 5, mechanical actuation of the nozzling devices is provided by solenoids. Solenoid-actuated nozzling device 10 regulates the flow of a refrigerant to a heat exchanger 18 in which the refrigerant takes on heat from the environment to be cooled. Solenoid-actuated nozzling device 10A regulates the flow of a refrigerant to a heat exchanger 18A in which the refrigerant takes on heat from the environment to be cooled. Nozzling devices 10B and 10C regulate the pressures in heat exchangers 18 and 18A respectively, allowing for different operating pressures within each heat exchanger. Refrigerant flows from the outlet of nozzling devices 10B and 10C through a filter-drier 21 to nozzling device 10D which regulates the pressure of the refrigerant flowing to a compressor 23. Compressed refrigerant flows to a heat exchanger 25 in which the refrigerant releases heat to the environment to be heated. Nozzling device 10E regulates the flow of refrigerant from and the pressure within heat exchanger 25. Nozzling device 10F bypasses refrigerant from the outlet of compressor 23 to the downstream side of nozzling device 10E, functioning as a differential pressure bypass of heat exchanger 25. Counter-flow heat exchanger 32 provides for heat exchange between the thermodynamic fluid flowing from the outlet of heat exchangers 18 and 18A to the compressor 23 and the thermodynamic fluid that flows from the outlet of heat exchanger 25 to the nozzling devices 10 and 10A. Refrigerant continually cycles through the system in an intermittent fashion as the pressure switches 14, 14A, 14B, 14C, 14D, 14E, and 14F respond to internal pressure information, alternately opening and closing the nozzling devices 10, 10A, 10B, 10C, 10D, 10E, and 10F respectively.

Solenoid-actuated nozzling device 10 is actuated by solenoid coil 11 which fully opens the valve element when electrically energized and fully closes the valve element when deenergized. Automatic reset close differential pressure switch 14 regulates the energization and deenergization of the solenoid coil 11. Electrical conduit 12 transfers electrical power between the electric contacts of pressure switch 14 and the solenoid coil 11. Electrical conduit 13 supplies electrical power to the solenoid coil 11 through the electric contacts of switch 14 and electrical conduit 12. Electric power from conduit 13 fully opens the nozzling device 10 when the contacts of switch 14 complete an electrical circuit between 13, 12, and 11. When the electrical circuit between 13, 12, and 11 is broken by the opening of the electrical contacts of the switch 14, the solenoid coil 11 is deenergized and the nozzling device 10 returns to its normally closed condition.

Capillary tube 15 transfers pressure information from downstream of the nozzling device 10 to the pressure switch 14. The pressure at which the switch is set to open the nozzling device 10 is chosen by human design criterion. Pressure information from within the system conduit 17 is transferred to the capillary tube 15 by the pressure tap 16. As compressor 23 lowers the pressure in the suction side of the thermodynamic system, pressure switch 14 opens nozzling device 10 when the pressure drops below a predetermined switch setting, permitting flow of the thermodynamic fluid from within the upstream system conduit 31 through the nozzling device 10 to the downstream system conduit 17. As the high velocity burst of thermodynamic fluid enters the downstream conduit 17 it produces an internal system pressure rise within the suction side of the system. When the internal system pressure within conduit 17 is above the automatic reset close differential of the pressure switch setting the electric contacts of the pressure switch 14 open and the solenoid coil 11 deenergizes closing the nozzling device 10 and stopping thermodynamic fluid flow through the nozzling device 10. With the nozzling device 10 closed the compressor 23 lowers the suction side pressure until it is below the pressure switch setting, resulting in the reopening of the nozzling device 10. As the nozzling device 10 alternates between fully open and fully closed conditions, internal thermodynamic fluid alternately flows and does not flow into heat exchanger 18.

The high velocity burst of thermodynamic fluid that enters the system downstream conduit 17 flows into the heat exchanger 18. In vapor-compression refrigeration or air-conditioning applications, heat exchanger 18 is an evaporator in which the refrigerant changes thermodynamic state from a liquid or mixed liquid-vapor state to a vapor state as heat energy is transferred from the external environment to the refrigerant. Heat energy transferred from the external environment to the internal thermodynamic fluid cools the external environment.

Solenoid-actuated nozzling device 10A is actuated by solenoid coil 11A which fully opens the valve element when electrically energized and fully closes the valve element when deenergized. Automatic reset close differential pressure switch 14A regulates the energization and deenergization of the solenoid coil 11A. Electrical conduit 12A transfers electrical power between the electric contacts of pressure switch 14A and the solenoid coil 11A. Electrical conduit 13A supplies electrical power to the solenoid coil 11A through the electric contacts of switch 14A and electrical conduit 12A. Electric power from conduit 13A fully opens the nozzling device 10A when the contacts of switch 14A complete an electrical circuit between 13A, 12A, and 11A. When the electrical circuit between 13A, 12A, and 11A is broken by the opening of the electrical contacts of the switch 14A, the solenoid coil 11A is deenergized and the nozzling device 10A returns to its normally closed condition.

Capillary tube 15A transfers pressure information from downstream of the nozzling device 10A to the pressure switch 14A. The pressure at which the switch is set to open the nozzling device 10A is chosen by human design criterion. Pressure information from within the system conduit 17A is transferred to the capillary tube 15A by the pressure tap 16A. As compressor 23 lowers the pressure in the suction side of the thermodynamic system, pressure switch 14A opens nozzling device 10A when the pressure drops below a predetermined switch setting, permitting flow of the thermodynamic fluid from within the upstream system conduit 31A through the nozzling device 10A to the downstream system conduit 17A. As the high velocity burst of thermodynamic fluid enters the downstream conduit 17A it produces an internal system pressure rise within the suction side of the system. When the internal system pressure within conduit 17A is above the automatic reset close differential of the pressure switch setting the electric contacts of the pressure switch 14A open and the solenoid coil 11A deenergizes closing the nozzling device 10A and stopping thermodynamic fluid flow through the nozzling device 10A. With the nozzling device 10A closed the compressor 23 lowers the suction side pressure until it is below the pressure switch setting, resulting in the reopening of the nozzling device 10A. As the nozzling device 10A alternates between fully open and fully closed conditions, internal thermodynamic fluid alternately flows and does not flow into heat exchanger 18A.

The high velocity burst of thermodynamic fluid that enters the system downstream conduit 17A flows into the heat exchanger 18A. In vapor-compression refrigeration or air-conditioning applications, heat exchanger 18A is an evaporator in which the refrigerant changes thermodynamic state from a liquid or mixed liquid-vapor state to a vapor state as heat energy is transferred from the external environment to the refrigerant. Heat energy transferred from the external environment to the internal thermodynamic fluid cools the external environment.

Solenoid-actuated nozzling device 10B is actuated by solenoid coil 11B which fully opens the valve element when electrically energized and fully closes the valve element when deenergized. Automatic reset close differential pressure switch 14B regulates the energization and deenergization of the solenoid coil 11B. Electrical conduit 12B transfers electrical power between the electric contacts of pressure switch 14B and the solenoid coil 11B. Electrical conduit 13B supplies electrical power to the solenoid coil 11B through the electric contacts of switch 14B and electrical conduit 12B. Electric power from conduit 13B fully opens the nozzling device 10B when the contacts of switch 14B complete an electrical circuit between 13B, 12B, and 11B. When the electrical circuit between 13B, 12B, and 11B is broken by the opening of the electrical contacts of the switch 14B, the solenoid coil 11B is deenergized and the nozzling device 10B returns to its normally closed condition.

Capillary tube 15B transfers pressure information from upstream of the nozzling device 10B to the pressure switch 14B. The pressure at which the switch is set to open the nozzling device 10B is chosen by human design criterion. Pressure information from within the system conduit 31B is transferred to the capillary tube 15B by the pressure tap 16B. As nozzling device 10 opens allowing refrigerant to enter heat exchanger 18 and raise its pressure, pressure switch 14B opens nozzling device 10B when the pressure rises above a predetermined switch setting, permitting flow of the thermodynamic fluid from within the upstream system conduit 31B through the nozzling device 10B to the downstream system conduit 17B. As the high velocity burst of thermodynamic fluid leaves the upstream conduit 31B it produces an internal system pressure drop within the heat exchanger 18. When the internal system pressure within heat exchanger 18 is below the automatic reset close differential of the pressure switch setting the electric contacts of the pressure switch 14B open and the solenoid coil 11B deenergizes closing the nozzling device 10B and stopping thermodynamic fluid flow through the nozzling device 10B. The pressure at which nozzling device 10B is set to close should be below the pressure at which nozzling device 10 is set to open so that nozzling device 10 can open before nozzling device 10B closes. With the nozzling device 10B closed heat transfer into heat exchanger 18 and refrigerant flowing from the opening of nozzling device 10 raises the pressure within heat exchanger 18 until it is above the pressure switch setting of pressure switch 14B, resulting in the reopening of the nozzling device 10B. As the nozzling device 10B alternates between fully open and fully closed conditions, internal thermodynamic fluid alternately flows and does not flow out of heat exchanger 18.

Solenoid-actuated nozzling device 10C is actuated by solenoid coil 11C which fully opens the valve element when electrically energized and fully closes the valve element when deenergized. Automatic reset close differential pressure switch 14C regulates the energization and deenergization of the solenoid coil 11C. Electrical conduit 12C transfers electrical power between the electric contacts of pressure switch 14C and the solenoid coil 11C. Electrical conduit 13C supplies electrical power to the solenoid coil 11C through the electric contacts of switch 14C and electrical conduit 12C. Electric power from conduit 13C fully opens the nozzling device 10C when the contacts of switch 14C complete an electrical circuit between 13C, 12C, and 11C. When the electrical circuit between 13C, 12C, and 11C is broken by the opening of the electrical contacts of the switch 14C, the solenoid coil 11C is deenergized and the nozzling device 10C returns to its normally closed condition.

Capillary tube 15C transfers pressure information from upstream of the nozzling device 10C to the pressure switch 14C. The pressure at which the switch is set to open the nozzling device 10C is chosen by human design criterion. Pressure information from within the system conduit 31C is transferred to the capillary tube 15C by the pressure tap 16C. As nozzling device 10A opens allowing refrigerant to enter heat exchanger 18A and raise its pressure, pressure switch 14C opens nozzling device 10C when the pressure rises above a predetermined switch setting, permitting flow of the thermodynamic fluid from within the upstream system conduit 31C through the nozzling device 10C to the downstream system conduit 17C. As the high velocity burst of thermodynamic fluid leaves the upstream conduit 31C it produces an internal system pressure drop within the heat exchanger 18A. When the internal system pressure within heat exchanger 18A is below the automatic reset close differential of the pressure switch setting the electric contacts of the pressure switch 14C open and the solenoid coil 11C deenergizes closing the nozzling device 10C and stopping thermodynamic fluid flow through the nozzling device 10C. The pressure at which nozzling device 10C is set to close should be below the pressure at which nozzling device 10A is set to open so that nozzling device 10A can open before nozzling device 10C closes. With the nozzling device 10C closed heat transfer into heat exchanger 18A and refrigerant flowing from the opening of nozzling device 10A raises the pressure within heat exchanger 18A until it is above the pressure switch setting of pressure switch 14C, resulting in the reopening of the nozzling device 10C. As the nozzling device 10C alternates between fully open and fully closed conditions, internal thermodynamic fluid alternately flows and does not flow out of heat exchanger 18A.

The high velocity bursts of thermodynamic fluid flowing out of heat exchangers 18 and 18A through conduits 17B and 17C converge into a common conduit 19 and flow to a counter-flow heat exchanger 32. The thermodynamic fluid flows out of counter-flow heat exchanger 32 through the conduit 20 to a suction line filter-drier 21, and through a conduit 31D to the inlet of nozzling device 10D.

Solenoid-actuated nozzling device 10D is actuated by solenoid coil 11D which fully closes the valve element when electrically energized and fully opens the valve element when deenergized. Automatic reset close differential pressure switch 14D regulates the energization and deenergization of the solenoid coil 11D. Electrical conduit 12D transfers electrical power between the electric contacts of pressure switch 14D and the solenoid coil 11D. Electrical conduit 13D supplies electrical power to the solenoid coil 11D through the electric contacts of switch 14D and electrical conduit 12D. Electric power from conduit 13D fully closes the nozzling device 10D when the contacts of switch 14D complete an electrical circuit between 13D, 12D, and 11D. When the electrical circuit between 13D, 12D, and 11D is broken by the opening of the electrical contacts of the switch 14D, the solenoid coil 11D is deenergized and the nozzling device 10D returns to its normally open condition.

Capillary tube 15D transfers pressure information from downstream of the nozzling device 10D to the pressure switch 14D. The pressure at which the switch is set to close the nozzling device 10D is chosen by human design criterion. Pressure information from within the system conduit 17D is transferred to the capillary tube 15D by the pressure tap 16D. Pressure switch 14D closes nozzling device 10D when the pressure rises above a predetermined switch setting, stopping flow of the thermodynamic fluid from within the upstream system conduit 31D through the nozzling device 10D to the downstream system conduit 17D. As thermodynamic fluid ceases to flow from the upstream conduit 31D compressor 23 lowers the pressure within conduit 17D. When the internal system pressure within conduit 17D is below the automatic reset close differential of the pressure switch setting the electric contacts of the pressure switch 14D open and the solenoid coil 11D deenergizes, opening the nozzling device 10D and allowing unrestricted thermodynamic fluid flow through the nozzling device 10D. As the nozzling device 10D alternates between fully open and fully closed conditions, internal thermodynamic fluid alternately flows and does not flow into compressor 23.

The compressor 23 transfers mechanical energy to the thermodynamic fluid, increasing the pressure and temperature of the refrigerant and discharging it through conduits 24 and 33 to the heat exchanger 25. The thermodynamic state of the refrigerant leaving the compressor 23 through the conduit 24 is in a superheated vapor state at a pressure and temperature above that of the refrigerant entering the compressor 23 through the conduit 17D.

In vapor-compression refrigeration or air-conditioning applications heat exchanger 25 is a condenser in which thermodynamic fluid changes thermodynamic state from a superheated vapor state to a liquid state as heat energy is transferred from the thermodynamic fluid to heat the external environment.

Thermodynamic fluid in the liquid state flows out of heat exchanger 25 through conduit 31E to the inlet of nozzling device 10E. Solenoid-actuated nozzling device 10E is actuated by solenoid coil lie which fully opens the valve element when electrically energized and fully closes the valve element when deenergized. Automatic reset close differential pressure switch 14E regulates the energization and deenergization of the solenoid coil 11E. Electrical conduit 12E transfers electrical power between the electric contacts of pressure switch 14E and the solenoid coil 11E. Electrical conduit 13E supplies electrical power to the solenoid coil lie through the electric contacts of switch 14E and electrical conduit 12E. Electric power from conduit 13E fully opens the nozzling device 10E when the contacts of switch 14E complete an electrical circuit between 13E, 12E, and 11E. When the electrical circuit between 13E, 12E, and lie is broken by the opening of the electrical contacts of the switch 14E, the solenoid coil 11E is deenergized and the nozzling device 10E returns to its normally closed condition.

Capillary tube 15E transfers pressure information from upstream of the nozzling device 10E to the pressure switch 14E. The pressure at which the switch is set to open the nozzling device 10E is chosen by human design criterion. Pressure information from within the system conduit 31E is transferred to the capillary tube 15E by the pressure tap 16E. Pressure switch 14E opens nozzling device 10E when the pressure rises above a predetermined switch setting, permitting flow of the thermodynamic fluid from within the upstream system conduit 31E through the nozzling device 10E to the downstream system conduit 17E. As the high velocity burst of thermodynamic fluid leaves the upstream conduit 31E it produces an internal system pressure drop within the heat exchanger 25. When the internal system pressure within heat exchanger 25 is below the automatic reset close differential of the pressure switch setting the electric contacts of the pressure switch 14E open and the solenoid coil 11E deenergizes closing the nozzling device 10E and stopping thermodynamic fluid flow through the nozzling device 10E. With the nozzling device 10E closed refrigerant flowing into heat exchanger 25 from the compressor 23 raises the pressure within heat exchanger 25 until it is above the pressure switch setting of pressure switch 14E, resulting in the reopening of the nozzling device 10E. As the nozzling device 10E alternates between fully open and fully closed conditions, internal thermodynamic fluid alternately flows and does not flow out of heat exchanger 25.

High pressure discharge of thermodynamic fluid from compressor 23 through conduit 24 can bypass heat exchanger 25 by flowing through conduit 31F to the inlet of nozzling device 10F. Solenoid-actuated nozzling device 10F is actuated by solenoid coil 11F which fully opens the valve element when electrically energized and fully closes the valve element when deenergized. Automatic reset close differential, differential pressure switch 14F regulates the energization and deenergization of the solenoid coil 11F. Electrical conduit 12F transfers electrical power between the electric contacts of pressure switch 14F and the solenoid coil 11F. Electrical conduit 13F supplies electrical power to the solenoid coil 11F through the electric contacts of switch 14F and electrical conduit 12F. Electric power from conduit 13F fully opens the nozzling device 10F when the contacts of switch 14F complete an electrical circuit between 13F, 12F, and 11F. When the electrical circuit between 13F, 12F, and 11F is broken by the opening of the electrical contacts of the switch 14F, the solenoid coil 11F is deenergized and the nozzling device 10F returns to its normally closed condition.

Capillary tube 15F transfers pressure information from downstream of the nozzling device 10F to the differential pressure switch 14F. Capillary tube 15G transfers pressure information from upstream of the nozzling device 10F to the differential pressure switch 14F. The differential upstream to downstream pressure at which the switch is set to open the nozzling device 10F is chosen by human design criterion. Upstream pressure information from within the system conduit 31F is transferred to the capillary tube 15G by the pressure tap 16G. Downstream pressure from within the system conduit 17F is transferred to the capillary tube 15F by the pressure tap 16F. Differential pressure switch 14F opens nozzling device 10F on a rise in differential upstream to downstream pressure above a predetermined switch setting, permitting flow of thermodynamic fluid from within the upstream system conduit 31F through the nozzling device 10F to the downstream system conduit 17F. As the high velocity burst of thermodynamic fluid leaves the upstream conduit 31F it tends to equalize the pressure within the downstream conduit 17F. When the difference in internal system pressure between upstream conduit 31F and downstream conduit 17F is below the automatic reset close differential of the differential pressure switch setting the electric contacts of the pressure switch 14F open and the solenoid coil 11F deenergizes closing the nozzling device 10F and stopping thermodynamic fluid flow through the nozzling device 10F. With the nozzling device 10F closed refrigerant flowing into upstream conduit 31F from the compressor 23 raises the pressure within conduit 31F until the differential between the pressure within conduit 31F and conduit 17F is above the differential pressure switch setting of pressure switch 14F, resulting in the reopening of the nozzling device 10F. As the nozzling device 10F alternates between fully open and fully closed conditions, internal thermodynamic fluid alternately flows and does not flow to bypass heat exchanger 25.

The high velocity bursts of thermodynamic fluid flowing out of nozzling devices 10E and 10F through conduits 17E and 17F converge into a common conduit 26 and flow to a liquid receiver 27. Thermodynamic fluid flows out of liquid receiver 27 through conduit 28 to counter-flow heat exchanger 32. The thermodynamic fluid that enters the counter-flow heat exchanger 32 through the conduit 28 in counter-flow heat relationship with the thermodynamic fluid flowing from the heat exchangers 18 and 18A to the compressor 23 emerges through the conduit 29. Refrigerant from conduit 29 bifurcates into two paths, one through conduit 44 to sight-glass 30 to conduit 31 to the inlet of nozzling device 10 and the other through conduit 45 to sight glass 30A to conduit 31A to the inlet of nozzling device 10A. Counter-flow heat exchanger 32 serves to further lower the temperature of the refrigerant leaving the heat exchanger 25 and entering the nozzling devices 10 and 10A by exchanging heat with the lower temperature refrigerant leaving heat exchangers 18 and 18A. Refrigerant flowing to the inlets of nozzling devices 10 and 10A complete a thermodynamic cycle.

The non-steady-state intermittent flow process through the nozzling devices in the present invention is an isentropic nozzling process whereas the corresponding flow process through the throttling valves in conventional steady-state thermodynamic systems of the prior art is an isenthalpic throttling process. In a throttling device there is a distinct means of flow restriction that results in thermodynamic fluid flow losses and a generation of thermodynamic entropy while providing a pressure drop to steady-state flow that is maintained by a compressor or a pump. The flow restriction results in what is considered from an engineering and thermodynamic analytical standpoint to be a negligible velocity increase as thermodynamic fluid experiences a drop in pressure in what is modeled thermodynamically as a constant enthalpy Joule-Thomson throttling expansion process. In a constant enthalpy Joule-Thomson throttling expansion process, for most thermodynamic fluids, temperature drops as the pressure drops. The Joule-Thomson expansion process is the classical basis of all steady-state direct expansion refrigeration, heat pump and air-conditioning cycles.

The nozzling devices are either fully open or fully closed with full port inlet to outlet flow and no flow restriction in the fully open condition. Nozzling devices have no reduction in dimension of flow cross-sectional area from inlet to outlet, except for what is required by the internal valve actuation assembly and nozzling parameters. The absence of flow restriction results in an isentropic nozzling flow process and a substantial fluid velocity increase as thermodynamic fluid experiences non-steady-state flow and a pressure drop. The pressure difference between the inlet and the outlet of the nozzling devices is produced by a compressor or a pump as the nozzling devices are fully closed. Inlet and outlet system pressures tend towards equalization as the non-steady-state nozzling flow processes occur when the nozzling devices are fully open. Slight flow losses and small departures from ideal isentropic flow through the nozzling devices are to be expected, but not to the extent to which throttling devices are designed to produce flow restrictions.

Both internal thermodynamic fluid pressure and enthalpy are transferred to internal thermodynamic fluid kinetic energy as thermodynamic fluid drops in pressure and enthalpy when flowing through a nozzling device; increasing from subsonic to sonic, to supersonic velocities, depending on operating conditions and nozzle design, as thermodynamic entropy remains constant. The isentropic nozzling expansion process, with the corresponding drop in pressure, temperature, and enthalpy, and the increase in velocity is the basis of non-steady-state refrigeration, heat pump, and air-conditioning cycles.

An isentropic thermodynamic process is more thermodynamically efficient than a non-isentropic, entropy generating thermodynamic process. As a result, non-steady-state intermittent flow thermodynamic cycles have fundamentally higher efficiencies than steady-state thermodynamic cycles. The causes and effects of the higher thermodynamic efficiencies are many and varied throughout the non-steady-state thermodynamic systems.

The high velocity intermittent mass transfer rates through nozzling devices produce high velocity intermittent heat transfer rates in the heat transfer processes that follow the nozzling processes. The lower velocity steady-state mass transfer rates through throttling devices produce lower heat transfer rates in the heat transfer processes that follow the throttling processes. Due to the drop in thermodynamic enthalpy in a nozzling process, the total amount of heat transfer following nozzling processes is greater than the total amount of heat transfer following constant enthalpy throttling processes.

The increased heat transfer rate and the increased heat transfer of a non-steady-state intermittent flow thermodynamic cycle results in an increased cooling capacity and an increased overall thermodynamic efficiency when compared to the cooling capacity and overall efficiency of a steady-state thermodynamic cycle. As is to be expected from fundamental thermodynamic principles, an increase in cooling capacity also results in an increase in heating capacity, for the heat energy absorbed in providing cooling must be released, providing for heating whether the heating is desirable or not.

With respect to engineering design parameters, for a given size compressor or pump, a non-steady-state thermodynamic system can be expected to require slightly larger heat exchangers to accommodate the higher heating and cooling performance of a non-steady-state thermodynamic system with a nozzling device than the corresponding heat exchangers of a steady-state thermodynamic system with a throttling device replacing the nozzling device. Given that one simply modifies an existing steady-state system by replacing the throttling device with a nozzling device, one can expect increased cooling of the compressor or pump as extra cooling is still able to be done by the refrigerant as it leaves the heat exchanger sized for steady-state cooling. In vapor-compression systems the extra cooling capacity can be noticed as return of liquid-vapor mist to the compressor as opposed to superheated vapor.

When a nozzling device is in its fully closed condition and flow of thermodynamic fluid ceases, a compressor or pump only has to provide compression work to lower the pressure on its suction side and raise the pressure on its discharge side by transferring mass of thermodynamic fluid from its suction side to its discharge side. When the nozzling device is in its fully open condition the compressor or pump has to provide compression and flow work to the thermodynamic fluid in transferring mass from its suction to its discharge side. The overall power and energy consumption of the compressor or pump is less when the nozzling device is closed than when it is open. The resulting transients in compressor or pump power and energy requirements as thermodynamic fluid alternately flows and ceases to flow is both qualitatively and quantitatively different than the steady and relatively constant compressor or pump power and energy requirements of a steady-state thermodynamic system at equilibrium.

In a steady-state thermodynamic system there is continual external energy transferred to the compressor or pump to provide pressure and flow work to the thermodynamic fluid. In a non-steady-state intermittent flow thermodynamic system there is only continual external energy transferred to the compressor or pump to provide pressure work, and intermittent external energy transferred to the compressor to provide flow work to the compressor or pump. Herein lies one form of energy savings that is readily observable by means of compressor or pump power and energy consumption measurements. The non-steady-state intermittent flow thermodynamic system will have an overall lower compressor or pump power and energy consumption when compared to a steady-state thermodynamic system.

For the same compressor or pump power and energy consumption a non-steady-state system will produce more cooling and heating at the same temperatures as a steady-state system or lower temperature cooling and higher temperature heating than a steady-state system. For the same cooling and heating capacity the non-steady-state system will require less compressor or pump power and energy consumption.

The efficiency savings for a non-steady-state system will increase as one compares lower and lower temperature cooling applications as the associated losses and entropy generation that result from the larger pressure drops through the throttling devices and the resulting increase in thermodynamic fluid flow losses and entropy generation will not occur in the comparable non-steady-state system. As one lowers the pressure setpoint at which a nozzling device is set to open one does not increase the flow losses through the nozzling device. In contrast, steady-state throttling devices employ greater flow restrictions to result in the lower operating pressures and temperatures.

The net result of the isentropic nozzling process in producing increased thermodynamic efficiencies in non-steady-state self-regulating intermittent-flow thermodynamic systems can be seen as lower compressor or pump power and energy consumption requirements while maintaining higher heat transfer rates and higher cooling and heating capacities in refrigeration, heat pump, and air-conditioning applications when compared to steady-state thermodynamic cycle based applications.

Due to the pressure build-up when a nozzling device is closed and the unrestricted full port flow through a nozzling device when open, the high velocity fluid flow transfers mass from the high pressure discharge side to the low pressure suction side of the thermodynamic system at a much faster rate than the compressor or pump can retransfer the mass from the suction side to the pressure discharge side, As a result, for the duration of the high velocity mass transfer there is a transient increase in suction pressure and a transient decrease in discharge pressure in what can be modeled thermodynamically as a constant volume mass transfer from the constant volume discharge side to the constant volume suction side. The magnitude of the pressure transients are partially determined by the pressure switches by means of their automatic reset and close differential functions. Due to the time required for the pressure switches and the mechanical actuation of the nozzling devices to react to the pressure transients and close the nozzling devices to stop fluid flow, pressure transients can be larger than the close differential of the pressure switches. The transient pressure drops in the high side and increases in the low side are self-regulated by the thermodynamic system as a whole as it exchanges energy with its environment, and will vary in real time as a result.

Due to dynamic damping effects and the time required for the high velocity heat transfers within the high and low pressure sides of a non-steady-state thermodynamic system, there can be a gradient in the pressure transients as a high velocity burst of refrigerant travels through the conduits and components. Directly corresponding to the pressure transients and gradients, there can be significant temperature transients as well as temperature gradients as the high velocity bursts of refrigerant travel through the conduits and components of both the high and low pressure sides. The temperature transient effects can be distinctly noted within heat exchangers due to their counter-intuitive results. Due to the pressure drop transients and temperature drop transients within a cooling load heat exchanger, the pressure ranges and temperature at its inlet can be considerably higher than the pressure ranges and temperature at its outlet. Even though the cooling load heat exchanger is absorbing heat, the temperature can drop from its inlet to its outlet. One explanation for the temperature drop is that the refrigerant entering the cooling load heat exchanger is traveling at a sufficiently high velocity so that there is not ample time for heat transfer at the inlet.

In steady-state heat exchangers, temperature increases from inlet to outlet as heat is absorbed. In steady-state vapor-compression systems the evaporator inlet is the coldest point, and the refrigerant absorbs heat at a relatively constant pressure and temperature until it is a saturated vapor and rises in temperature at relatively constant pressure as the thermodynamic fluid becomes superheated vapor. The fact that the temperature can drop substantially from the inlet to the outlet of a non-steady-state evaporator and the fact that there is a range of pressures in the evaporator between moments of flow and no flow makes the thermodynamic concept of superheat not obviously applicable to non-steady-state evaporators. Non-steady-state evaporator temperatures are better described as a result of a race between the rate at which the intermittent thermodynamic fluid flow cools down the conduit walls and the rate at which the external environment heats up the conduit walls. The temperature of the conduit walls is a result of the overall equilibrium resulting from the opposing heat transfer rates and is not a direct indication of the thermodynamic state of the refrigerant within the conduit as is the case in steady-state refrigeration systems. In steady-state systems there is a one-to-one correspondence between the internal conduit pressure and temperature and the thermodynamic state of the refrigerant. Due to the intermittent flow characteristics throughout a non-steady-state thermodynamic system and the varying pressure and temperature transients, thermodynamic fluid states are better described by ranges and time profiles than by a one-to-one correspondence of thermodynamic states for given positions along the conduits and components.

Evaporator superheat determination is utilized to modulate the internal metering mechanisms in current throttling expansion devices. In non-steady-state metering systems superheat determination is not utilized, nor relied upon. In steady-state systems superheat is considered a necessary evil for modulating expansion valves; it is more efficient for compressors to receive saturated vapor than superheated vapor, yet some temperature difference in the evaporator is required to mechanically modulate expansion valves. Steady-state systems attempt to minimize compressor power requirements by minimizing superheat. In non-steady-state systems superheat can be avoided completely, resulting in lower compressor power requirements and increased thermodynamic efficiencies.

The intermittent mass flows, pressure and temperature transients, ranges, and gradients within non-steady-state thermodynamic systems are both qualitatively and quantitatively different than the steady and relatively constant pressures, temperatures, and mass flows maintained within steady-state thermodynamic systems.

In vapor-compression systems, the temperature transients that accompany the varying pressure transients in the high pressure side are all temperature drops that accompany the pressure drops and increase thermodynamic efficiency. The pressure transient drops within the sub-cooling section also tends to have the refrigerant flash into vapor as well. One indication of proper charging of a non-steady-state thermodynamic vapor-compression system with refrigerant is when there is minimal flashing of refrigerant within the subcooling section to vapor. This results in primarily liquid discharge through the nozzling devices into the evaporator heat exchangers. The discharge of subcooled liquid into non-steady-state evaporator heat exchangers by non-steady-state nozzling devices as opposed to the discharge of mixed liquid-vapor phase mist into steady-state evaporator heat exchangers by steady-state throttling devices is an immediate indication of the increased cooling capabilities of non-steady-state thermodynamic systems. Sub-cooled liquid can absorb more heat than mixed liquid-vapor mist as it vaporizes in the evaporator heat exchanger. A liquid-line sight glass provides visual information as to the state of the refrigerant during the intermittent flow processes and charging of the system to determine whether there is adequate refrigerant.

The pressure transients are very dynamic phenomenon that repeat with each mass transfer. The duration of high velocity flow with a nozzling device fully open is less than the duration of the no-flow condition with the nozzling device fully closed. When the nozzling device is fully closed the compressor or pump retransfers the mass from the suction side to the pressure discharge side that was transferred to the suction side from the pressure discharge side by the high velocity burst of refrigerant. The relative frequency of high velocity mass transfers to low velocity retransfers depends on the rate at which the compressor or pump is able to retransfer the mass from the suction to the pressure discharge side. The nozzling device will always open and transfer mass from the pressure discharge side to the suction side at the rate determined by the compressor or pump as it functions to provide for the cooling and heating loads in the heat exchangers. Thus the non-steady-state intermittent flow thermodynamic system self-regulates the flow of its internal thermodynamic fluid and its internal pressures and temperatures as it continually seeks equilibrium with changing internal and external environment conditions. As internal and external environment conditions change, the rate at which the nozzling device opens and closes will vary as the thermodynamic system adapts to accommodate the changing environment conditions.

The system will seek a state of minimum overall entropy generation on its own, to reach the most efficient equilibrium with respect to its internal and external environment. There is no need for any external input of optimization information that could be provided for example from a human hand and an adjustable timer or a microprocessor controller to determine the rate at which the nozzling device should open and close. Such external control would try to impose operating pressures and temperatures on the thermodynamic system different than those of the minimum entropy generation sought by the system on its own and would result in less efficient operation. The only operational setpoint that is predetermined by human design criterion is the setting of the pressure switch for the pressure at which the nozzling device is to open or close. The magnitudes of the resulting pressure and temperature transients will be determined by the thermodynamic system on its own and will change as the thermodynamic system seeks to establish equilibrium with its internal and external environment. The self-regulating aspect of non-steady-state systems with respect to the rate at which the nozzling device opens and closes in metering the flow of refrigerant is phenomenologically very different from the modulating aspects of throttling devices of the prior art in metering the flow of refrigerant. The prior art in metering devices modulates the size of the throttling restriction based on temperature and or pressure feedback, or regulates the flow through a fixed throttling restriction by either partially or fully opening and closing a valve by means of a mechanical or microprocessor controlled electromechanical assembly with temperature and or pressure or liquid-level feedback. The non-steady-state metering system utilizes a single pressure setpoint to provide metering in the time domain by providing for intermittent flow and cessation of flow as opposed to modulation of flow. It is of primary importance that as there is only one pressure setpoint, the metering of thermodynamic fluid flow in the time domain is determined solely by the compressor or pump as the thermodynamic system seeks thermal equilibrium with its internal and external environment. Any additional setpoint control of the opening and closing of a nozzling device in addition to the pressure switch can result in degenerate and dysfunctional states that are far from equilibrium.

The mechanical feedback loop between the compressor or pump, the heat exchangers, the pressure switches and the nozzling devices self-regulates the internal flow of thermodynamic fluid. Only the pressure setpoints are determined by human design criterion. Due to the pressure and temperature transients and ranges produced by non-steady-state systems, close temperature regulation of the space to be cooled or heated can be provided by using an automatic reset close differential temperature switch to turn on and off the power to the compressor or pump. A delay timer can be used in conjunction with the temperature switch regulating the temperature of a space to prevent short cycling of the compressor. Non-uniform temperature profiles from the inlet to the outlet of heat exchangers can be effectively integrated by the secondary heat exchange fluid between the heat exchangers and the space to be cooled or heated as the secondary heat exchange fluid provides for an averaging of the overall supply temperature to the space to be cooled or heated.

Figure 6:
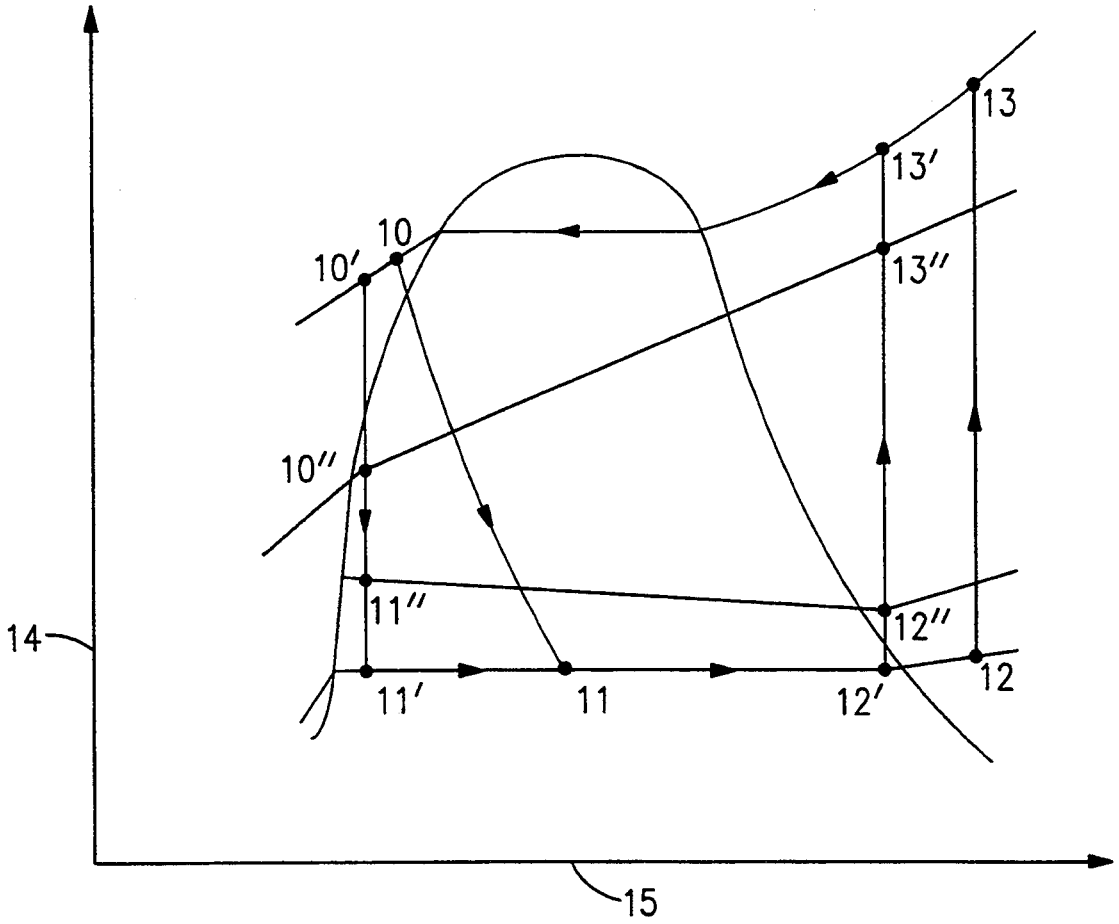
FIG. 6 shows a simple thermodynamic temperature-entropy diagram comparing a non-steady-state intermittent flow thermodynamic cycle to a steady-state thermodynamic cycle.

FIG. 6 shows a simple thermodynamic temperature-entropy diagram comparing a non-steady-state intermittent flow thermodynamic cycle to a steady-state thermodynamic cycle. The abscissa, denoted by 15, represents thermodynamic entropy. The ordinate axis denoted by 14 represents thermodynamic temperature. The non-steady-state thermodynamic cycle and steady-state thermodynamic cycle process steps are demarcated by what is commonly referred to as a vapor dome.

The steady-state thermodynamic cycle process steps are denoted by 10-11-12-13-10. The non-steady-state thermodynamic cycle process steps are denoted by 10′,10″-11′,11″-12′,12″-13′,13″-10′,10″. Each of the non-steady-state process steps represent pressure ranges.

The non-steady-state thermodynamic cycle process step 10′,10″-11′,11″ represents an isentropic nozzling flow process with a corresponding drop in temperature, pressure, and enthalpy from the pressure range 10′,10″ to the pressure range 11′,11″. Thermodynamic state 10′ is in the subcooled liquid region. Thermodynamic state 10″ is in the mixed liquid-vapor phase region at a pressure below 10′. Thermodynamic state 11′ is in the mixed liquid-vapor phase region. Thermodynamic state 11″ is in the mixed liquid-vapor phase region at a pressure above 11′. Thermodynamic states in the range 10′-10″ represent nozzling device inlet states. Thermodynamic states in the range 11′-11″ represent nozzling device outlet states, and evaporator heat exchanger inlet states. Thermodynamic states in the ranges 10′10″ and 11′-11″ are all at the same entropy as a result of the isentropic nozzling process. Range 10′-10″ represents the nozzle inlet pressure, temperature, and enthalpy transient drop as the nozzle is open; with range 10″-10′ representing the subsequent transient rise in pressure, temperature, and enthalpy when the nozzle is closed. Range 11′-11″ represents the nozzle outlet and evaporator inlet pressure, temperature, and enthalpy transient rise, with range 11″-11′ representing the subsequent transient drop in pressure, temperature, and enthalpy when the nozzle is closed and the compressor removes mass from the suction side of the system.

The non-steady-state thermodynamic cycle process step 11′,11″-12′,12″ represents an non-isothermal, non-isobaric phase change accompanying the non-steady-state mass and heat transfer within the evaporator heat exchanger as heat energy is absorbed from the external environment. Thermodynamic fluid changes state from the range of mixed liquid-vapor states represented by 11′-11″ to the range of states represented by 12′-12″. Thermodynamic state 12′ is in the mixed liquid-vapor phase region. Thermodynamic state 12″ is in the superheated vapor phase region. Range 11′-11″ represents an evaporator inlet pressure rise as a high velocity mass transfer occurs when the nozzling device fully opens. Range 12′-12″ represents an evaporator outlet pressure rise as a high velocity mass transfer occurs when the nozzling device fully opens. The evaporator outlet pressure range 12′-12″ is substantially less than the evaporator inlet pressure range 11′-11″. This gradient in pressure ranges from evaporator inlet to outlet can be considered to be due to dynamic damping effects within the evaporator, as well as non-uniform mass removal from within the evaporator by the compressor. As the compressor is closer to the outlet of the evaporator than the inlet, it continually removes mass from the evaporator outlet while high velocity mass enters the evaporator inlet at a rate faster than the compressor can react to remove it. The result of the non-uniform and non-steady-state mass transfers is a non-uniform pressure profile within the evaporator during mass transfers, and non-steady-state heat transfers. The pressure ranges and the pressure gradient from the inlet to the outlet of the evaporator and the non-steady-state heat transfers result in temperature ranges and a temperature gradient from the inlet to the outlet of the evaporator. When the nozzling device is fully closed, the compressor lowers the pressure in the entire evaporator until it is uniform, and until the pressure reaches the pressure at which the nozzling device is set to open by actuation from the pressure switch. The pressure ranges 11'-11" and 12'-12" represent a pressure rise from 11' to 11" and from 12' to 12" when the nozzling device opens, and a pressure drop from 11" to 11' and from 12" to 12' when the nozzling device is closed. The range of inlet and outlet thermodynamic states accompanying the pressure rises are considered to be at constant entropy as high velocity mass enters the evaporator. The range of inlet and outlet thermodynamic states accompanying the pressure drops are considered to be at constant entropy as mass leaves the evaporator at range of velocities from high to low due to the action of the compressor.

There is a non-steady-state time profile of thermodynamic states that is represented by the ranges 11',11" and 12',12" and the non-steady-state heat and mass transfer processes that is extremely over-simplified when represented in a two-dimensional drawing. Further representational difficulties arise from the far-from-equilibrium mass and heat transfer processes that occurs when a nozzling device opens. Mass can be transferred into the evaporator at a sufficiently high velocity and flow rate that even though it is at a lower pressure, the mass does not have enough time to change in phase at the evaporator inlet. As the high velocity mass travels into the evaporator it can violently flash from liquid, or subcooled liquid into vapor. The far-from-equilibrium thermodynamic states are not represented on the two-dimensional thermodynamic temperature-entropy diagram where all states are taken to be at equilibrium. At the moment, FIG. 6 is taken to be a simplified representational diagram to provide as comprehensible as possible a description of the fundamental differences between non-steady-state and steady-state thermodynamic cycles.

The non-steady-state thermodynamic cycle process step 12',12"-13',13" represents an isentropic compression process with a corresponding increase in temperature, pressure, and enthalpy from the range of states 12'-12" to the range of states 13'-13" which are in the superheated vapor region. Range 13'-13" represents the compressor outlet and the condenser heat exchanger inlet. There is a transient temperature, pressure, and enthalpy rise from 13'-13" as the nozzle is fully closed due to the action of the compressor. When the nozzle opens there is a transient temperature, pressure, and enthalpy drop from 13" to 13' as a high velocity mass transfer occurs from the high pressure to low pressure side of the system faster than the compressor can maintain pressure and flow. The non-steady-state compressor power and energy use is represented by the non-steady-state isentropic pressure rise from 12',12" to 13',13" in two dimensions, which are inadequate to convey the drop in power and energy use as the nozzle is closed and the increase in power and energy use when the nozzle opens, and the non-steady-state time and thermodynamic state profiles that accompany the non-steady-state energy, power, and pressure profiles.

The non-steady-state thermodynamic cycle process step 13',13"-10',10" represents a non-isobaric phase change from superheated vapor to saturated vapor states followed by an non-isobaric, non-isothermal phase change from saturated vapor to saturated liquid states followed by an non-isobaric phase change from saturated liquid to subcooled liquid states. The non-steady-state phase changes occur within a condenser heat exchanger, where range 13'-13" represents the condenser inlet and range 10'-10" represents the condenser outlet. The condenser heat exchanger functions to change the phase of the thermodynamic fluid as it releases heat to the environment. The total heat released is equivalent to the amount of heat absorbed in the evaporator added to the heat equivalent of the amount of energy utilized by the compressor. Range 10'-10" represents a condenser outlet pressure drop as a high velocity mass transfer occurs when the nozzling device fully opens. Range 13'-13" represents a condenser inlet pressure drop as a high velocity mass transfer occurs when the nozzling device fully opens. The condenser inlet pressure range 13'-13" is substantially less than the condenser outlet pressure range 10'-10". This gradient in pressure ranges from condenser outlet to inlet can be considered to be due to dynamic damping effects within the condenser, as well as non-uniform mass input to the condenser by the compressor. As the compressor is closer to the inlet of the condenser than the outlet, it continually inputs mass to the condenser inlet while high velocity mass leaves the condenser outlet at a rate faster than the compressor can react to replace it. The result of the non-uniform and non-steady-state mass transfers is a non-uniform pressure profile within the condenser during mass transfers, and non-steady-state heat transfers. The pressure ranges and the pressure gradient from the outlet to the inlet of the evaporator and the non-steady-state heat transfers result in temperature ranges and a temperature gradient from the outlet to the inlet of the condenser. When the nozzling device is fully closed, the compressor raises the pressure in the entire condenser until it is uniform, and until the pressure and temperature is sufficient to transfer the total energy absorbed by the non-steady-state system as heat to the ambient environment. The rate at which the nozzling device opens and closes will be self-determined by the non-steady-state thermodynamic system as the compressor lowers the suction side pressure and raises the high side pressure to provide for and accommodate the amount and rate of heat energy transferred by the cooling and heating heat exchangers. The mechanical feedback system will continuously self-optimize as the thermodynamic system seeks a minimum entropy generating equilibrium with its external and internal environment. For heat pump operation, matching the pressure switch setting for a close correlation to the desired temperature of the heated or cooled space might result in condenser pressure information feedback for heating and evaporator pressure information feedback for cooling. With condenser pressure information feedback for heating, a pressure switch would open a nozzling device on a rise in inlet pressure to permit flow of thermodynamic fluid from a condenser to an evaporator. The pressure switch would be set to a pressure close to that required for the corresponding temperature desired in the space to be heated. Sufficient refrigerant charge would be required to enable the system to reach the pressure switch setting. Evaporator pressures and temperatures would be self-determined by the non-steady-state system as the cooling load heat exchanger absorbed heat energy from its ambient environment.

The pressure ranges 10'-10" and 13'-13" represent a pressure drop from 10' to 10" and from 13' to 13" when the nozzling device opens, and a pressure rise from 10" to 10' and from 13" to 13' when the nozzling device is closed. The range of inlet and outlet thermodynamic states accompanying the pressure drops are considered to be at constant entropy as high velocity mass leaves the condenser. The range of inlet and outlet thermodynamic states accompanying the pressure rises are considered to be at constant entropy as mass enters the condenser due to the action of the compressor. The non-steady-state time profiles of thermodynamic states at the inlet and outlet, and within the condenser due to the non-steady-state mass flows and neat transfers are not adequately represented by the two-dimensional aspects of FIG. 6.

The steady-state thermodynamic cycle process step 10-11 represents an isenthalpic process with a corresponding decrease in temperature and pressure and increase in entropy. Thermodynamic state 10 is in the subcooled liquid region. Thermodynamic state 11 is in the mixed vapor-liquid phase region.

The steady-state thermodynamic cycle process step 11-12 represents an isothermal, isobaric phase change from mixed vapor-liquid phase to saturated vapor phase followed by an isobaric process from saturated vapor phase to superheated vapor phase with a corresponding increase in thermodynamic temperature. Thermodynamic state 12 is in the superheated vapor region.

The steady-state thermodynamic cycle process step 12-13 represents an isentropic process with a corresponding increase in temperature, pressure, and enthalpy. Thermodynamic state 13 is in the superheated vapor region.

The steady-state thermodynamic cycle process step 13-10 represents an isobaric phase change from superheated vapor to saturated vapor followed by an isobaric, isothermal phase change from saturated vapor to saturated liquid followed by an isobaric phase change from saturated liquid to subcooled liquid.

The non-steady-state thermodynamic cycle process 10',10"-11',11" and the steady-state thermodynamic cycle process 10-11 would be commonly referred to as expansion processes.

The non-steady-state thermodynamic cycle process 11',11"-12',12" and the steady-state thermodynamic process 11-12 would be commonly referred to as heat absorption processes.

The non-steady-state thermodynamic process 12',12"-13',13" and the steady-state thermodynamic process 12-13 would be commonly referred to as compression processes.

The non-steady-state thermodynamic process 13',13"-10',10" and the steady-state thermodynamic process 13-10 would be commonly referred to as heat release processes.

The critical differences between the non-steady-state thermodynamic process 10',10"-11',11" and the steady-state thermodynamic process 10-11 is that the thermodynamic fluid at the non-steady-state thermodynamic states 11'-11" has higher kinetic energy, lower enthalpy, and lower entropy than the corresponding thermodynamic fluid at steady-state thermodynamic state 11. The higher kinetic energy, lower enthalpy, and lower entropy at the non-steady-state thermodynamic states 11'-11" result in a higher heat transfer rate and a greater heat transfer in the non-steady-state heat absorption process 11',11"-12',12" than in the corresponding steady-state heat absorption process 11-12. Lower enthalpy is evidenced by the increased sub-cooling of thermodynamic state 10' when compared to thermodynamic state 10.

The critical difference between the non-steady-state thermodynamic process 12',12"-13',13" and the steady-state thermodynamic process 12-13 is that due to the intermittent thermodynamic flow characteristics of the non-steady-state thermodynamic cycle processes, the net compressor energy rate use is less than in the corresponding steady-state thermodynamic cycle process. The energy savings is due to the intermittent pressure and flow work requirements in the non-steady-state compression process as compared to the continuous pressure and flow work requirements in the steady-state compression process. While the steady-state compressor continually maintains a pressure rise from thermodynamic state 12 and thermodynamic state 13, the non-steady-state compressor is able to cycle the high and low side system pressures between the ranges 13'-13" and 12'-12" respectively. From fundamental thermodynamic principles, lowering the average high side pressure and raising the average low side pressure while transferring heat at the same high and low side ambient temperatures tends to increase thermodynamic efficiency. A further increase in efficiency is due to the compression of a range of mixed liquid-vapor to saturated vapor to slightly superheated vapor in a non-steady-state cycle as opposed to compression of solely superheated vapor in a steady-state cycle.

The critical difference between the non-steady-state thermodynamic cycle process 13',13"-10',10" and the steady-state thermodynamic cycle process 13-10 is the greater heat transfer rate in the non-steady-state thermodynamic cycle process due to higher kinetic energy of the thermodynamic fluid in the non-steady-state flow process within the heat exchanger from entrainment of fluid out of the heat exchanger by the nozzling process 10',10"-11',11" than in the corresponding steady-state thermodynamic cycle heat transfer process 13-10. Furthermore, the non-steady-state process produces increased sub-cooling when compared to the steady-state process. The total amount of heat transferred in the non-steady-state thermodynamic cycle when compared to the steady-state cycle would depend on design criterion; for example, given equal cooling capacities, the lower compression power and energy requirements of non-steady-state compression would result in lower heating load heat transfer.

Herein lies the basis for the increased efficiency of the non-steady-state thermodynamic cycle when compared to the corresponding steady-state thermodynamic cycle: by replacing an isenthalpic throttling process with an isentropic nozzling process, a non-steady-state thermodynamic cycle requires lower energy and power use and provides increased heat transfer and heat transfer rate than a steady-state thermodynamic cycle.

Figure 7:
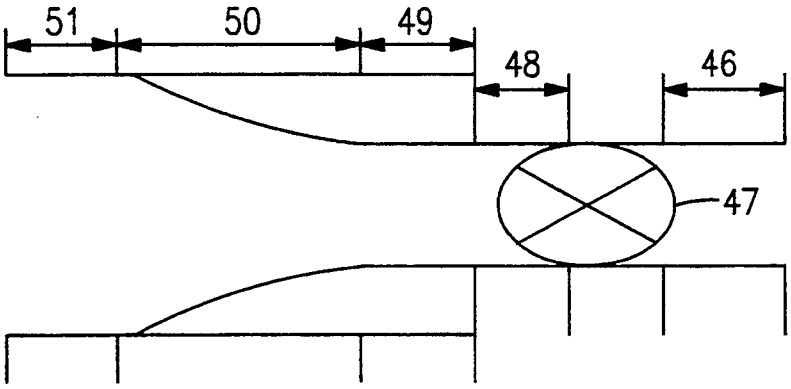
FIG. 7 shows a simple representative schematic of a nozzling device in which a complete valve element precedes a complete nozzle element in the direction of fluid flow.
Figure 8:
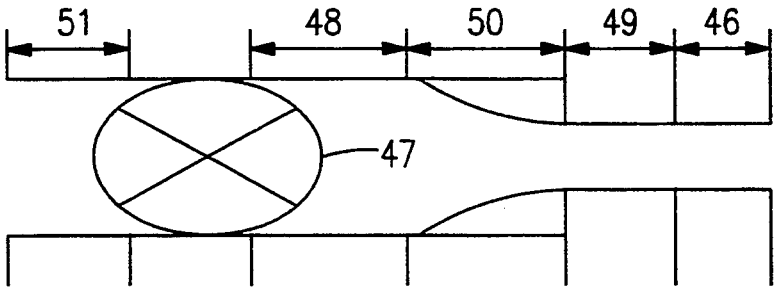
FIG. 8 shows a simple representative schematic of a nozzling device in which a complete nozzle element precedes a complete valve element in the direction of fluid flow.
Figure 9:
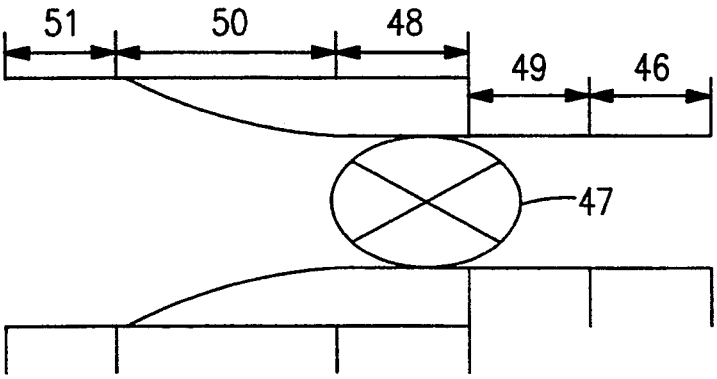
FIG. 9 shows a simple representative schematic of a nozzling device in which the valve elements are integrally composed with the nozzle elements.

In the nozzling devices depicted in FIG. 7, FIG. 8, and FIG. 9, the mechanical valve element 47 that fully opens and closes is a simple schematic representation of the valve element referred to within the nozzling devices of the previously described thermodynamic systems. Straight conduit section 49 and diverging conduit section 50 are simple schematic representations of the straight and diverging sections of a straight-diverging nozzle. Nozzling device inlet 46 and nozzling device outlet 51 function as transition elements for connecting to inlet and outlet conduits respectively.

With respect to FIG. 7, the integral formation of valve inlet 46, mechanical valve element 47 and valve outlet 48 could be considered a separate commercially manufactured and purchasable unit that is actuated in a binary fashion, either fully open or fully closed, with full port flow in its open condition, and no flow in its closed position. Valve inlet 46 functions as the inlet to the nozzling device and as a transition element for connection to an inlet conduit. Valve outlet 48 functions as a transition element for connection with the straight nozzle section 49, and as such, functions as the nozzle inlet as well. Straight nozzle section 49 is integrally formed with diverging nozzle section 50 to produce a complete straight-diverging nozzle, which could be considered a separate commercially manufactured and purchasable unit that would match the complete and separate valve for a given set of operating conditions. Nozzle outlet 51 functions as the outlet to the nozzling device and as a transition element for connection to an outlet conduit. Thus the nozzle and the valve are attached in series with respect to fluid flow, with the valve preceding the nozzle.

With the mechanical valve element 47 closed, the fluid within nozzling device inlet 46 is at a higher pressure than the fluid within transition section 48, straight nozzle section 49, diverging nozzle section 50 and nozzling device outlet 51, and there is no flow from the high pressure side to the low pressure side. The fluid within the high and low pressure sides of the nozzling device can be considered to be stationary, with no directed kinetic energy in the direction of potential flow. When the mechanical valve element 47 rapidly fully opens, the difference in pressure between the inlet and outlet sides of the nozzling device results in fluid flow through the nozzling device. With no change in flow cross sectional area within nozzling device inlet 46, mechanical valve element 47 and transition element 48, fluid would accelerate as though through a straight section until it reached the beginning of straight nozzle section 49. Depending on the magnitude of the pressure difference across the valve element 47, the fluid from within transition element 48 could accelerate to sonic velocity as it traveled from the inlet of straight nozzle section 49 to the nozzle throat at the juncture between straight nozzle section 49 and diverging nozzle section 50. Depending on the magnitude of the pressure difference across the nozzling device and the relative cross sectional areas of the nozzle throat and the outlet of the diverging nozzle section 50, the fluid could accelerate to supersonic velocity until it reached the nozzling device outlet 51. Supersonic velocity fluid would then travel through nozzling device outlet 51 to the connecting outlet conduit. With the rapid closing of the mechanical valve element 47, fluid flow ceases through the nozzling device, and the fluid at the inlet and outlet of the nozzling device returns to its relatively stationary condition.

With respect to FIG. 8, the integral formation of valve inlet 48, mechanical valve element 47 and valve outlet 51 could be considered a separate commercially manufactured and purchasable unit that is actuated in a binary fashion, either fully open or fully closed, with full port flow in its open condition, and no flow in its closed position. Valve outlet 51 functions as the outlet to the nozzling device and as a transition element for connection to an outlet conduit. Valve inlet 48 functions as a transition element for connection with the diverging nozzle section 50, and as such, functions as the nozzle outlet as well. Straight nozzle section 49 is integrally formed with diverging nozzle section 50 to produce a complete straight-diverging nozzle, which could be considered a separate commercially manufactured and purchasable unit that would match the complete and separate valve for a given set of operating conditions. Nozzle inlet 46 functions as the inlet to the nozzling device and as a transition element for connection to an inlet conduit. Thus the nozzle and the valve are attached in series with respect to fluid flow, with the nozzle preceding the valve.

With the mechanical valve element 47 closed, the fluid within nozzling device inlet 46, straight nozzle section 49, diverging nozzle section 50 and transition section 48 is at a higher pressure than the fluid within nozzling device outlet 51, and there is no flow from the high pressure side to the low pressure side. The fluid within the high and low pressure sides of the nozzling device can be considered to be stationary, with no directed kinetic energy in the direction of potential flow. When the mechanical valve element 47 rapidly fully opens, the difference in pressure between the inlet and outlet sides of the nozzling device results in fluid flow through the nozzling device. Depending on the magnitude of the pressure difference across the valve element 47, the fluid from within nozzling device inlet 46 could accelerate to sonic velocity as it traveled from the inlet of straight nozzle section 49 to the nozzle throat at the juncture between converging nozzle section 49 and diverging nozzle section 50. Depending on the magnitude of the pressure difference across the nozzling device and the relative cross sectional areas of the nozzle throat and the outlet of the diverging nozzle section 50, the fluid could accelerate within the diverging nozzle section 50 to supersonic velocity until it reached the transition element 48. With no change in flow cross sectional area within transition element 48, mechanical valve element 47 and nozzling device outlet 51 fluid flow through these elements would remain at supersonic velocity. Supersonic velocity fluid would then travel through nozzling device outlet 51 to the connecting outlet conduit. With the rapid closing of the mechanical valve element 47, fluid flow ceases through the nozzling device, and the fluid at the inlet and outlet of the nozzling device returns to its relatively stationary condition.

With respect to FIG. 9, the physical nozzle and valve inlet and outlet elements are congruent within the body of the nozzling device. Nozzling device inlet 46 and nozzling device outlet 51 serve as transition elements for connection to inlet and outlet conduits respectively. The inlet to mechanical valve element 47 is simultaneously a valve inlet and the straight nozzle section 49. The outlet to mechanical valve element 47 is simultaneously a valve outlet and the diverging nozzle section 50. Transition element 48 incorporates the mechanical valve element 47 as a transition between the straight and diverging sections of the nozzle.

With the mechanical valve element 47 closed, the fluid within nozzling device inlet 46 and straight nozzle section 49 is at a higher pressure than the fluid within diverging nozzle section 50 and nozzling device outlet 51, and there is no flow from the high pressure side to the low pressure side. The fluid within the high and low pressure sides of the nozzling device can be considered to be stationary, with no directed kinetic energy in the direction of potential flow. When the mechanical valve element 47 rapidly fully opens, the difference in pressure between the inlet and outlet sides of the nozzling device results in fluid flow through the nozzling device. Depending on the magnitude of the pressure difference across valve element 47, the fluid within nozzling device inlet 46 could accelerate to sonic velocity as it traveled from the inlet of straight nozzle section 49 to the open mechanical valve element 47. With no change in flow cross sectional area within mechanical valve element 47 and transition element 48, considered to be the throat of the nozzle, the fluid would remain at sonic velocity until it reached the beginning of diverging nozzle section 50. Depending on the magnitude of the pressure difference across the nozzling device and the relative cross sectional areas of the nozzle throat and the outlet of the diverging nozzle section 50, the fluid could accelerate to supersonic velocity until it reached the nozzling device outlet 51. Supersonic velocity fluid would then travel through nozzling device outlet 51 to the connecting outlet conduit. With the rapid closing of the mechanical valve element 47, fluid flow ceases through the nozzling device, and the fluid at the inlet and outlet of the nozzling device returns to its relatively stationary condition.

The spirit of the congruence of the nozzle and valve elements within the nozzling valve depicted in FIG. 9 is that within valve bodies of the current art, nozzle elements can be designed and fabricated to coordinate with the mechanical opening and closing aspects of the valve so that the nozzling function of accelerating fluid flow can occur, resulting in high fluid outlet velocities with minimal flow losses. It is important to note that nozzle elements can take the form of straight conduit sections, converging conduit sections, and diverging conduit sections, and that the nozzling devices depicted in FIG. 7, FIG. 8, and FIG. 9 are not restricted to containing straight-diverging nozzles. Nozzle inlet sections can be either straight or converging; nozzle outlet sections can be either straight, converging, or diverging. The resulting nozzle inlet-outlet combinations include: straight-straight, straight-converging, straight-diverging, converging-straight, converging-converging, and converging-diverging. For example, a mechanical valve element with straight conduit inlet and outlet sections still functions as a nozzling device, as the internal fluid flow can take on converging aspects and increase in velocity within a straight section when accompanying a pressure difference from inlet to outlet. The use of converging nozzle sections are for the purpose of optimizing the acceleration of fluid flow, with minimal or negligible pressure drop caused by the convergence. The pressure drop across a nozzling device is to result from the closed valve condition with the compressor or pump operating, and not from flow restriction within the nozzling device.

Due to the transient pressures expected during fluid flow, and the drop in the pressure difference across the nozzling device as the fluid flow tends to equalize pressures, converging and diverging nozzle sections, and the throat section should be designed accordingly to avoid shocks within the diverging nozzle section that would bring the fluid back to subsonic velocity. In choosing the form of a nozzling device, the most important criterion is that flow should be able to accelerate to the highest velocities possible for the duration of a flow event with minimal flow losses.

The invention has been shown in preferred forms and by way of example and modifications and variations are possible within the spirit of the invention.

The invention, therefore, is not intended to be limited to any specified form or embodiment, except insofar as such limitations are expressly set forth in the claims.

I claim:

1. A thermodynamic system comprising a compressor or pump, at least one heat exchanger, a conduit recirculating a heat exchange fluid through the system, at least one nozzling device including a valve and a nozzle, the valve having only fully open and closed binary positions with no intermediate positions and causing minimal restriction to fluid flow when open, the nozzle being configured to accelerate fluid flow to a maximum attainable velocity with minimum restriction to fluid flow, and means sensing the pressure of the heat exchange fluid in said conduit to open fully or close the valve in response to a change in pressure in the conduit to impart an intermittent operation to the valve and permit intermittent substantially unrestricted acceleration of bursts of fluid flow through the nozzling device.

2. A thermodynamic system as set forth in claim 1 wherein the nozzling device comprises a mechanical valve element and an associated nozzle composed of elements which include at least one of straight, converging, and diverging sections that provide for the acceleration of fluid flow within minimal restriction.

3. A thermodynamic system as set forth in claim 2 wherein the mechanical valve element is joined in series with the nozzle.

4. A thermodynamic system as set forth in claim 2 wherein the mechanical valve element is integrally formed with the nozzle.

5. A thermodynamic system as set forth in claim 1 including a solenoid for moving the valve between the fully open and closed positions, and a pressure controlled switch responsive to the sensing means to operate the solenoid to fully open and close the valve in response to a change in pressure in the conduit.

6. A thermodynamic system as set forth in claim 1 in which the sensing means senses the pressure in the conduit in at least one of the following locations: (i) downstream of the nozzling device and (ii) upstream of the nozzling device and (iii) both upstream and downstream of the nozzling device.

7. A thermodynamic system as set forth in claim 1 in which the system includes at least two heat exchangers, one receiving heat from the heat exchange fluid and the other supplying heat to the heat exchange fluid, and in which the compressor is connected in the system by the conduit intermediate the two heat exchangers, the heat exchanger communicating with the discharge side of the compressor being the source of the heat exchange fluid supplied to the nozzling device.

8. A thermodynamic system as set forth in claim 1 in which the system as a whole functions in a mechanical feedback loop utilizing internal pressure information to regulate the opening and closing of the nozzling device, providing for continual thermodynamic efficiency self-optimization in real time as the system exchanges energy with its external environment.

9. A thermodynamic system as set forth in claim 1 including at least one nozzling device intermediate two heat exchangers, the sensing means being in communication with the conduit adjacent each nozzling device for controlling the operation of the nozzling device, and at least one reversing valve for changing the direction of flow of the heat exchange fluid through the heat exchangers.

10. A thermodynamic system as set forth in claim 1 including nozzling devices upstream and downstream respectively of a heat exchanger regulating the intermittent substantially unrestricted acceleration of heat exchange fluid flow entering and leaving the heat exchanger.

11. A thermodynamic system as set forth in claim 1 including a plurality of heat exchangers arranged in parallel, and respective nozzling devices for regulating the intermittent substantially unrestricted acceleration of heat exchange fluid flow to each heat exchanger.

12. A thermodynamic system as set forth in claim 1 including at least two of said nozzling devices arranged in parallel for regulating the intermittent substantially unrestricted acceleration of fluid flow from the heat exchanger and bypassing the heat exchanger.

13. A thermodynamic system as set forth in claim 1 including a nozzling device upstream of the compressor or pump for regulating the intermittent substantially unrestricted acceleration of heat exchange fluid flow to the compressor or pump.

14. A thermodynamic system comprising a compressor or pump, at least one heat exchanger, a conduit recirculating a heat exchange fluid through the system, at least one nozzling device including a mechanical valve element and an associated nozzle, the valve element having only fully open and closed binary positions with no intermediate positions and causing minimal restriction to fluid flow when open, a solenoid for moving the valve element between its fully open and closed positions, the nozzle being configured to accelerate fluid flow to a maximum attainable velocity with minimum restriction to fluid flow, means for sensing the pressure of the heat exchange fluid in said conduit, a pressure controlled switch responsive to a change in the sensed pressure to intermittently operate the solenoid to fully open and close the valve element.

15. In a thermodynamic process wherein a heat exchange fluid is circulated, a method for continual thermodynamic efficiency self-optimization in real time as energy is exchanged in the process with an external environment which comprises a) directing the heat exchange fluid through a valve and nozzle, b) sensing the pressure of the heat exchange fluid in the system, and c) automatically opening fully or closed the valve in a binary fashion in response to a change in the sensed pressure thus permitting substantially unrestricted bursts of fluid flow through the valve and permitting acceleration of the intermittent bursts of fluid flow by the nozzle, whereby maximum attainable velocity with minimum restriction is achieved in the fluid flow through the nozzle.

16. A method according to claim 15 wherein the opening and closing of the valve functions in a mechanical feedback loop utilizing internal pressure information to self-regulate said opening and closing of the valve and flow through the nozzle.

17. A thermodynamic system comprising a compressor, at least one heat exchanger, a conduit recirculating a heat exchange fluid through the system, at least one nozzling device through which flow is substantially isentropic, a means sensing at least one thermodynamic property in association with the system, the sensing means self-regulating the actuation of at least one nozzling device based on a setpoint as the system exchanges energy with its environment.

* * * * *